US011491074B2

(12) United States Patent
Witte et al.

(10) Patent No.: US 11,491,074 B2
(45) Date of Patent: Nov. 8, 2022

(54) EXOSKELETON DEVICE EMULATION SYSTEM

(71) Applicant: Carnegie Mellon University, Pittsburgh, PA (US)

(72) Inventors: Kirby Ann Witte, Pittsburgh, PA (US); Steven H. Collins, Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 591 days.

(21) Appl. No.: 16/037,771

(22) Filed: Jul. 17, 2018

(65) Prior Publication Data

US 2019/0015287 A1 Jan. 17, 2019

Related U.S. Application Data

(60) Provisional application No. 62/604,703, filed on Jul. 17, 2017.

(51) Int. Cl.

| | |
|---|---|
| ***A61H 3/00*** | (2006.01) |
| ***A61H 1/00*** | (2006.01) |
| ***A61H 1/02*** | (2006.01) |

(52) U.S. Cl.

CPC ..... *A61H 3/00* (2013.01); *A61H 1/00* (2013.01); *A61H 1/024* (2013.01); *A61H 1/0237* (2013.01); *A61H 2201/1207* (2013.01); *A61H 2201/1215* (2013.01); *A61H 2201/164* (2013.01); *A61H 2201/165* (2013.01); *A61H 2201/1676* (2013.01); *A61H 2201/1685* (2013.01); *A61H 2201/50* (2013.01); *A61H 2201/501* (2013.01); *A61H 2201/5058* (2013.01); *A61H 2201/5061* (2013.01); *A61H 2201/5064* (2013.01);

(Continued)

(58) Field of Classification Search

CPC ..... A61H 3/00; A61H 1/0262; A61B 34/71; B25J 9/0006

See application file for complete search history.

(56) References Cited

U.S. PATENT DOCUMENTS

| | | | | |
|---|---|---|---|---|
| 4,606,542 A * | 8/1986 | Segal | A61F 5/0125 482/105 |
| 5,020,790 A * | 6/1991 | Beard | A61F 5/0102 482/4 |
| 10,231,859 B1 * | 3/2019 | Thorne | A61H 1/024 |

(Continued)

OTHER PUBLICATIONS

English translation of Zhao et al. (CN-106826762-A) Jun. 2017.*

*Primary Examiner* — Justine Ryu
*Assistant Examiner* — Christopher E Miller
(74) *Attorney, Agent, or Firm* — Fish & Richardson P.C.

(57) ABSTRACT

An exoskeleton system includes a cable, an exoskeleton device, a controller, and a motor. The exoskeleton device includes a frame comprising a first portion coupled to a second portion by a joint, a first crossbar supported by the first portion of the frame, and a second crossbar supported by the second portion of the frame. The first crossbar is configured to redirect the cable toward the second crossbar, and the cable is configured to affix to the second crossbar. The motor is connected to the cable and configured to cause the cable to provide a torque about the joint. The controller controls the motor to adjust the torque. The cable provides the torque by exerting a first force on the first crossbar and a second force on the second crossbar. The cable provides the torque about the joint in a first direction.

23 Claims, 16 Drawing Sheets

(52) U.S. Cl.
CPC .. *A61H 2203/0406* (2013.01); *A61H 2205/10* (2013.01); *A61H 2205/102* (2013.01)

(56) References Cited

U.S. PATENT DOCUMENTS

| | | | | |
|---|---|---|---|---|
| 10,350,092 | B1 * | 7/2019 | Caputo | A61F 2/66 |
| 10,426,687 | B2 * | 10/2019 | Meuleman | F16H 21/32 |
| 2005/0059908 | A1 * | 3/2005 | Bogert | A61H 3/00 601/5 |
| 2007/0129653 | A1 * | 6/2007 | Sugar | A61H 1/0237 601/5 |
| 2008/0039756 | A1 * | 2/2008 | Thorsteinsson | A61B 5/4585 602/23 |
| 2010/0036302 | A1 * | 2/2010 | Shimada | A61F 5/0102 602/16 |
| 2013/0102935 | A1 * | 4/2013 | Kazerooni | A61H 3/061 601/35 |
| 2013/0226048 | A1 * | 8/2013 | Unluhisarcikli | A61H 1/00 601/34 |
| 2013/0245524 | A1 * | 9/2013 | Schofield | A61F 5/0127 602/16 |
| 2015/0051527 | A1 * | 2/2015 | Potter | A61F 5/0125 602/16 |
| 2015/0190249 | A1 * | 7/2015 | Ishibashi | A61H 1/0244 623/24 |
| 2015/0272811 | A1 * | 10/2015 | Choi | B25J 9/0006 623/27 |
| 2015/0374573 | A1 * | 12/2015 | Horst | A61F 5/0125 602/16 |
| 2016/0107309 | A1 * | 4/2016 | Walsh | A61H 3/00 248/550 |
| 2016/0193101 | A1 * | 7/2016 | Pu | A61F 2/70 623/24 |
| 2016/0361222 | A1 * | 12/2016 | Publicover | A61F 5/0123 |
| 2017/0027735 | A1 * | 2/2017 | Walsh | A61F 5/0102 |
| 2017/0340506 | A1 | 11/2017 | Zhang et al. | |
| 2018/0125738 | A1 | 5/2018 | Witte et al. | |
| 2018/0161229 | A1 * | 6/2018 | Choi | B25J 9/0006 |

* cited by examiner

Varus/Valgus Rotation

EXOSKELETON DEVICE EMULATION SYSTEM

CLAIM OF PRIORITY

This application claims priority under 35 U.S.C. § 119(e) to U.S. Patent Application Ser. No. 62/604,703, filed on Jul. 17, 2017, the entire contents of which are hereby incorporated by reference.

GOVERNMENT SUPPORT CLAUSE

This invention was made with government support under U.S. Pat. No. 1,355,716 awarded by the National Science Foundation. The government has certain rights in the invention.

BACKGROUND

Exoskeletons have been used for performance restoration and enhancement. Recently, the importance of the natural dynamics of the human body, energy input, and comfort of human-robot interactions have been given increased attention in exoskeleton applications. In these approaches to exoskeleton assistance, torque control is crucial. In such systems, series-elastic actuators are commonly used to provide low error torque tracking in the presence of unknown and changing human dynamics.

Exoskeletons are commonly developed as end-user products. Time and money are spent developing autonomous devices with onboard power, actuation and control. Once these products are developed, they can be difficult to adjust and can apply a limited range of assistance strategies, which may or may not be successful.

SUMMARY

The exoskeleton described herein includes a rigid or semi-rigid construction. The exoskeleton is configured for actuation by off-board motors with power transmitted through one or more flexible cables (e.g., Bowden cables). In some implementations, the exoskeleton is referred to as an end effector. The exoskeleton includes a modular device with respect to the motor controller and motors. For example, the cables that tether the exoskeleton to the motors and motor controller can be removed from the exoskeleton. A different exoskeleton device can be swapped in for the removed device. In another example, the removed exoskeleton device can be adjusted and replaced into the exoskeleton system. The exoskeleton system, which acts as a tethered test bed for exoskeleton devices, enables high-bandwidth (e.g., high frequency) torque control of exoskeleton devices on users. The motors are large enough to provide the torque required for high-bandwidth control. The motors enable application of higher peak torques than a knee is capable of producing.

The exoskeleton device includes a knee exoskeleton device. In some implementations, the knee exoskeleton device can be interfaced with multiple motors, each providing torque to a joint of the exoskeleton by a flexible cable. For example, a first motor provides a torque by a first cable to assist in extension of the knee of a user, and a second motor provides a second torque by a second cable to assist in flexion of the knee of the user. The controller receives data from one or more sensors of the knee exoskeleton. For example, the sensors can include one or more strain gauges, encoders, force sensors, and so forth. The controller controls each of first and second motors to provide torque as needed by the exoskeleton (e.g., while the user flexing his knee) to assist the user.

The exoskeleton devices and systems described herein provide several advantages. The exoskeleton system enables different exoskeleton devices to be tested with a user. Adjustments can be made to the exoskeleton device easily to improve performance of the exoskeleton device. High-torque motors can be used for high-bandwidth control of the exoskeleton device, improving performance of the exoskeleton device in assisting a user in flexing and extending a knee of the user. Both directions of motion can be actuated with the motors. In some implementations, a first torque is applied to the joint in a first direction by the cable and the motor, and a second torque is applied to the joint in a second direction with a spring or other device that is antagonistic to the torque provided by the motor and cable. The modular testbed of the exoskeleton system enables rapid and inexpensive testing of design and control strategies for assisting gait. The data collected from these tests can be used to develop useful autonomous devices. As stated above, developing testbeds in which actuation and control are located off-board simplifies the process of designing, manufacturing and testing exoskeletons. Off-board power and actuation allows for large motors that can easily meet or exceed the peak torque, velocity and power naturally produced at the knee. High bandwidth enables testbeds to accurately render torque profiles to give the user the most realistic experience of interacting with an emulated device. For example, it may be useful to give subjects the experience of wearing a passive exoskeleton to discover the most effective spring and clutch properties before developing new hardware. High performance capabilities of the testbed broaden the available experimental space without adding complexity to the exoskeleton design.

Highly capable testbeds may be used to discover the most useful controller settings for an individual using human-in-the-loop optimization. Clinics may be able to use optimization strategies like this on testbeds for prescription of robotic devices such as exoskeletons and prostheses. The exoskeleton system is a powerful research tool enabling rapid testing of assistance strategies that can aid in physical therapy, augmentation of athletic ability, reducing the metabolic cost of walking or running, or improving stability in the elderly in the long term.

The exoskeleton system includes a cable, an exoskeleton device, a controller, and motors. The exoskeleton device includes a frame including a first portion coupled to a second portion by a joint, a first crossbar supported by the first portion of the frame, and a second crossbar supported by the second portion of the frame. The first crossbar is configured to redirect the cable toward the second crossbar. The cable is configured to be affixed to the second crossbar. The motor that is connected to the cable and configured to cause the cable to provide a torque about the joint. The controller for controlling the motor to adjust the torque, where the cable is configured to provide the torque by exerting a first force on the first crossbar and a second force on the second crossbar, and where the cable is further configured to provide the torque about the joint in a first direction.

In some implementations, the exoskeleton device includes a third crossbar supported by the first portion of the frame on an opposite side to the first crossbar. In some implementations, the exoskeleton device includes a fourth crossbar supported by the second portion of the frame on an opposite side to the second crossbar. In some implementations, the torque is first torque, and the third crossbar is coupled to the fourth crossbar by a spring configured to provide a second torque about the joint in a second direction opposite to the first direction.

In some implementations, the cable is a first cable, the motor is a first motor, the torque is a first torque, and the exoskeleton system includes a second cable and a second motor that is connected to the second cable and configured to cause the second cable to provide a second torque around the joint in a direction opposite to the first torque. In some implementations, the first motor and the second motor are each independently controlled by the controller.

In some implementations, the first portion of the frame is attachable to an upper leg portion of a user. The second portion of the frame is attachable to a lower leg portion of the user to cause the joint to be collocated with a knee of the user. In some implementations, the first direction corresponds to a direction of knee extension of the user, and a second direction about the joint opposite the first direction corresponds to a direction of knee flexion of the user.

In some implementations, the exoskeleton device includes a strain gauge affixed to the second crossbar, the strain gauge configured to measure a force of the cable on the second crossbar.

In some implementations, the first crossbar includes a pulley configured to redirect the cable toward the second crossbar. In some implementations, the joint includes an encoder configured to measure an amount of rotation of the joint. In some implementations, the joint includes a triple pulley joint. The triple pulley joint includes a first pulley set coupled to the first portion of the frame by a first hinge, a second pulley set coupled to the second portion of the frame by a second hinge, and a third pulley set coupled to the first pulley set and coupled to the second pulley set. In some implementations, the triple pulley joint enables at least five degrees of freedom the joint. The triple pulley joint includes a first cable configured to provide a first torque about the joint in the first direction, and a second cable configured to provide a second torque about the joint in a second direction opposite the first direction. In some implementations, the triple pulley joint includes a third cable configured to prevent extension of the joint in the first direction past an extension threshold. In some implementations, one or more the cables include a Bowden cable.

In some implementations, the exoskeleton device includes a frame. The frame includes a first portion coupled to a second portion by a joint. A first crossbar is supported by the first portion of the frame. A second crossbar is supported by the second portion of the frame. A third crossbar is supported by the first portion of the frame on an opposite side to the first crossbar. A fourth crossbar is supported by the second portion of the frame on an opposite side to the second crossbar. In some implementations, the first crossbar is configured to receive a first cable and to redirect the first cable toward the second crossbar. In some implementations, the second crossbar is configured to affix to the first cable to enable the first cable to provide a first torque about the joint in a first direction. In some implementations, the third crossbar is configured to receive a second cable and redirect the second cable toward the fourth crossbar. In some implementations, the fourth crossbar is configured to affix to the second cable to enable the second cable to provide a second torque about the joint in a second direction opposite the first direction.

In some implementations, the first portion of the frame is attachable to an upper leg portion of a user and the second portion of the frame is attachable to a lower leg portion of a user to cause the joint to be collocated with a knee of the user. In some implementations, the first direction corresponds to a direction of knee extension of the user. The second direction corresponds to a direction of knee flexion of the user. In some implementations, the exoskeleton device includes a first sensor affixed to the second crossbar. The first sensor is configured to measure a first force of the first cable on the second crossbar. In some implementations, the exoskeleton device includes a second sensor affixed to the fourth crossbar. The second sensor is configured to measure a second force of the second cable on the fourth crossbar.

In some implementations, the first crossbar includes a first pulley configured to redirect the first cable toward the second crossbar. In some implementations, the third crossbar includes a second pulley configured to redirect the second cable toward the fourth crossbar. In some implementations, the joint includes an encoder configured to measure rotation of the joint.

In some implementations, the joint comprises a triple pulley joint. The triple pulley joint includes a first pulley set coupled to the first portion of the frame by a first hinge, a second pulley set coupled to the second portion of the frame by a second hinge, and a third pulley set coupled to the first pulley set and coupled to the second pulley set. In some implementations, the triple pulley joint enables at least five degrees of freedom for the joint. In some implementations, the triple pulley joint includes a first joint cable configured to provide a torque about the joint in the first direction and a second cable configured to provide a torque about the joint in the second direction. In some implementations, the triple pulley joint includes a third cable configured to prevent extension of the joint past an extension threshold.

In some implementations, the first cable and second cable each comprises a Bowden cable.

Other embodiments and advantages of the exoskeleton system and devices described herein are apparent from the description of the devices and systems provided below.

DETAILED DESCRIPTION

Figure 1:
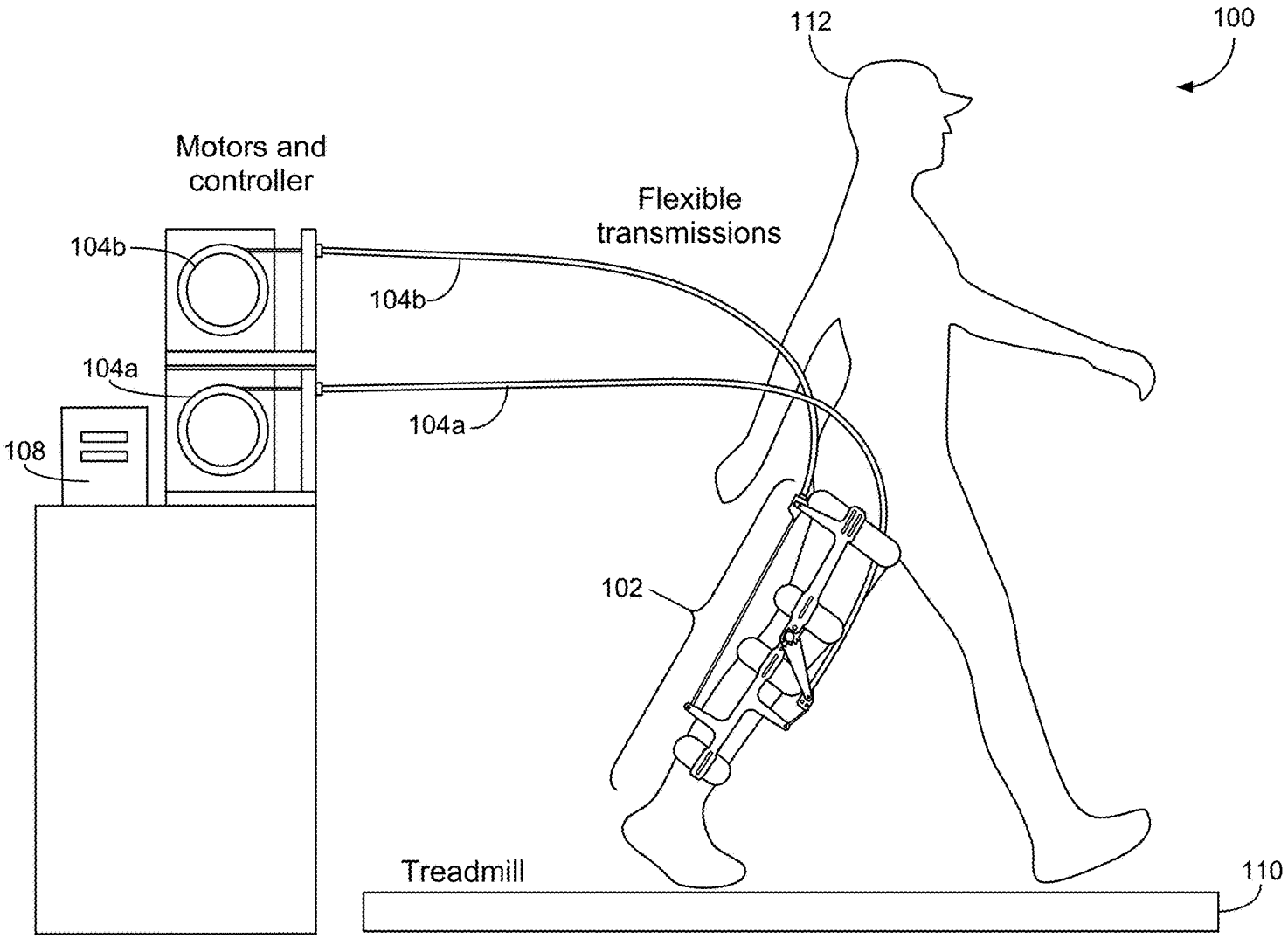
FIG. 1 shows an example exoskeleton system.

FIG. 1 shows an example exoskeleton system 100. The exoskeleton system 100 can be used to emulate one or more different exoskeleton devices. An exoskeleton device 102 is connected by one or more cables 104*a-b* (also referred to as a cable 104) to one or more motors 106*a-b* (also referred to as motor 106). While two motors 106*a*, 106*b* and two corresponding cables 104*a*, 104*b* are shown, in some implementations, the exoskeleton system 100 includes a single cable 104 and motor 106. A controller 108 is configured to control the motors 106*a-b*. The controller can control the motors 106*a-b* either independently from one another or in coordination with one another. In some implementations, a separate controller controls each motor 106*a-b*. The exoskeleton device 102 can be affixed to a user 112. The exoskeleton device includes a knee exoskeleton device configured to assist the flexion and extension of a knee of the user 112. For the exoskeleton system 100, a treadmill 110 or other similar device can be used to enable the user 112 to walk, run, and otherwise flex and extend the user's knee. The controller 108 reads signals from one or more sensors affixed to the exoskeleton device 102. In response, the controller 108 causes a torque on a joint of the exoskeleton device by sending a signal to one or more of the motors 106*a-b*. The motors 106*a-b* are instructed to cause a tension in the respective cables 104*a-b*, thus transmitting mechanical power to the exoskeleton device 102 via the cables. The cables 104*a-b* are each configured to cause a torque on a joint of the exoskeleton device 102 as needed to assist the user 112 in flexing and extending the knee.

In some implementations, mechanical power is transmitted from powerful off-board motors to the exoskeleton device 102 via flexible Bowden cable transmissions (e.g., cables 104*a-b*). The exoskeleton device 102 can be divided into two major sections: a thigh portion and a calf portion, described in further detail with respect to FIG. 2. The thigh portion and the calf portion are joined by a joint (e.g., an aluminum rotary joint) that is approximately collocated with the center of rotation of the knee of the user 112. The exoskeleton device 102 attaches to the user with four padded straps located at the top of the thigh, just above the knee, just below the knee, and above the ankle.

The mass and overall envelope of exoskeleton device 102 are made as small as possible to reduce the torques required to control the exoskeleton device 102. The exoskeleton device 102 includes mass properties similar to other exoskeleton device that are being emulated. In order to closely approximate another exoskeleton device, mass can be added to the exoskeleton device 102 to match the emulated device. Lower mass reduces the energy requirements of the user for using the device, relative to a heavier device, and reduces control over the device by the controller 108. For example, running for any amount of time while wearing an exoskeleton with sub-optimal settings may be exhausting. Energetic penalties incurred by wearing an exoskeleton can be reduced by minimizing mass and size of protrusions on the medial aspect of the leg as distal mass and increased circumduction for leg clearance are costly.

The exoskeleton system 100 enables rapid prototyping and customization of the exoskeleton device 102 for a particular user. Even if an exoskeleton has high performance capabilities, its utility is limited if it is not comfortable. Comfort is maintained by applying forces normal to the user, achieving a good fit and accommodating the range of motion of the assisted joint. Forces should be applied normal to the skin as shear forces applied to skin cause discomfort, pain and increased risk of injury and occlusion. Applying forces over large surface areas allows for greater magnitudes of applied force while maintaining comfort. Users may vary in anthropometry, such as body mass and leg length. Designing a new device for each user results in a comfortable fit, but at an additional expense. Adjustability or modularity provide freedom to fit a range of users, but adjustability often adds mass by requiring additional components, and modularity may require bulky connective hardware to allow frequent reconfiguration. Designing for compliance in select directions can allow a better fit without added components by enabling the frame to act as a flexure to bend in and out to accommodate users of different shapes. Select compliance can also enable an exoskeleton to allow additional limited degrees of freedom that are not explicitly accounted for in the joint design.

The human knee produces large peak torques and absorbs impact during walking and running. A knee exoskeleton is useful in conjunction with an ankle exoskeleton in order to better assist the gastrocnemius muscle. When an ankle exoskeleton is used to aid walking, activity in the soleus and gastrocnemius muscle can decrease resulting in a reduction in metabolic energy consumption. Assistance provided at the ankle alone is limited as the gastrocnemius acts to both plantarflex the ankle and flex the knee during push-off. An exoskeleton capable of assisting both the ankle and the knee may be most effective to target the gastrocnemius for assistance.

The human knee has six degrees of freedom including flexion and extension, external and internal rotation, varus and valgus rotation, and three degrees of translation, which must be accommodated either explicitly or through high compliance in order to maintain comfort. The knee is not well approximated by a rotary joint as the axis of rotation displaces between 8 and 20 mm as the joint flexes. The knee also experiences between 5 and 10 degrees of external rotation automatically as the leg extends. The degree of varus or valgus rotation of the knee is nearly constant for each individual, but ranges across subjects. The last three degrees of freedom are translational, the largest of which is anterior/posterior sliding between the femur and the tibia that can be as much as 19 mm. Compliance between the exoskeleton frame and the user's skeleton may be sufficient to accommodate these movements without bulky explicit degrees of freedom. However, as described below, alternate joint devices can be used that accommodate such motion by the user's knee.

The exoskeleton device 102 provides structural compliance in select directions and provides torques similar to those observed in the biological knee during running. The knee exoskeleton end-effector is actuated by two powerful off-board servomotors (AKM73P-ACCNR-00, Kollmorgen, Radford, Va., USA) and a real-time controller, with mechanical power transmitted through flexible Bowden cable tethers. The controller and tether elements of this system are described in detail in U.S. Pat. Application Pub. No. 2017/0340506 and U.S. Pat. Application Pub. No. 2018/0125738, the contents of each being incorporated in entirety herein.

Figure 2:
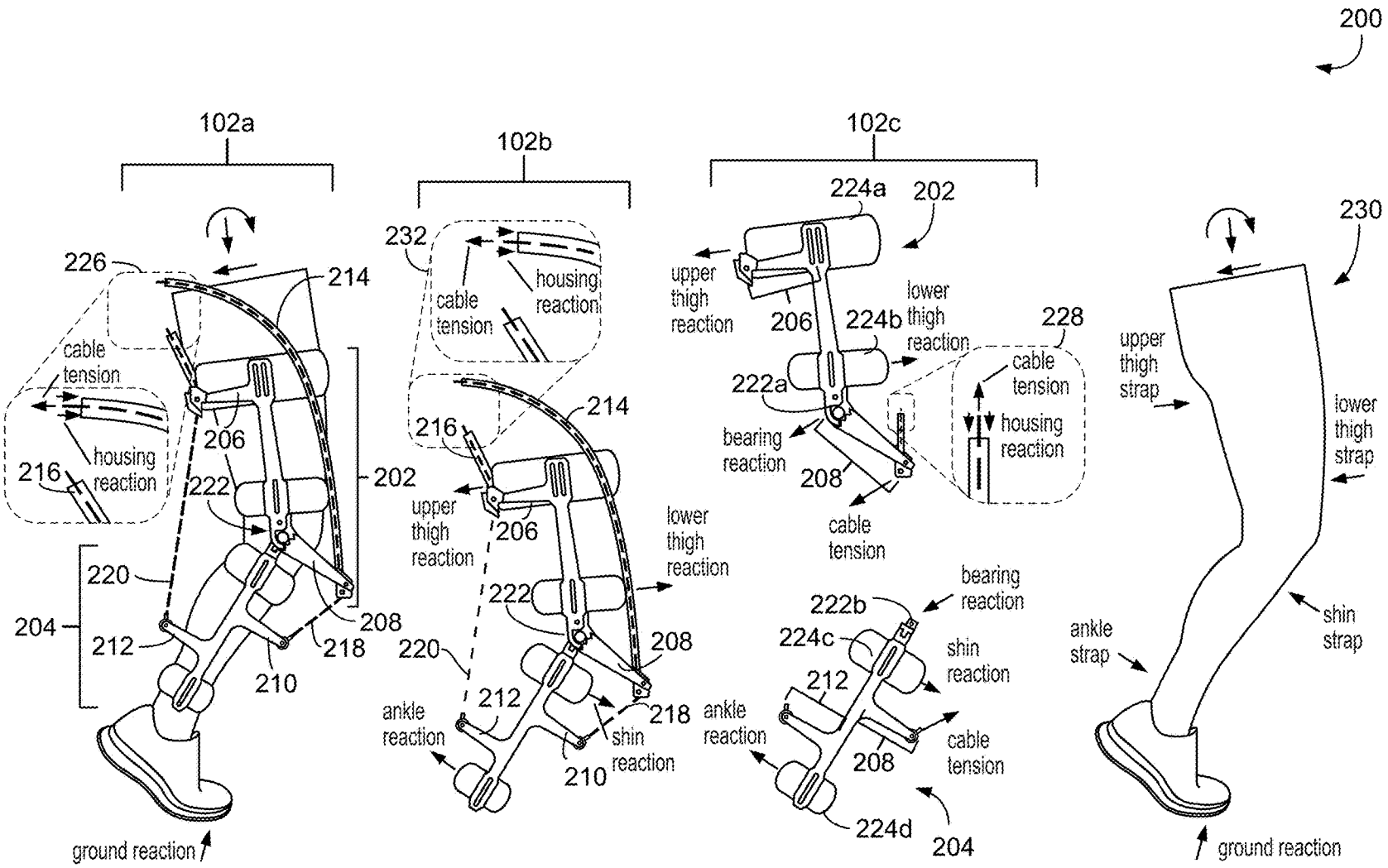
FIG. 2 shows an example exoskeleton device.

Turning to FIG. 2, an example exoskeleton device 200 (e.g., which can be exoskeleton device 102 described in relation to FIG. 1) is shown in varying configurations 102*a*, 102*b* and 102*c*. Arrows show example forces when a user is extending a leg in the exoskeleton device 200. The exoskeleton device 200 includes a frame. The frame includes a first portion 202 (e.g., a thigh portion) and a second portion 204 (e.g., a calf portion). The frame of the exoskeleton device 200 consists of planar carbon fiber struts on the medial and lateral aspects of the leg. The struts are configured to support crossbars on the frame of the exoskeleton device 200. The crossbars (described in detail with respect to FIGS. 3-4) are configured to couple with the cables 214, 216.

The first portion 202 of the exoskeleton device 200 includes a first set of struts 206 and a second set of struts 208. Because FIG. 2 shows the exoskeleton device 200 from the side, only one strut of each strut set is visible. A flexion upper crossbar (not shown) is supported by struts 206 on the first portion 202 of the exoskeleton device. An extension upper crossbar (not shown) is supported by struts 208 of the first portion 202 of the exoskeleton device 200. In some implementations, a single cable is needed through the extension upper crossbar, and the flexion upper crossbar is affixed to a spring. In some implementations, the flexion upper crossbar is interfaced with cable 216.

The second portion 204 of the exoskeleton device 200 includes a third set of struts 210 and a fourth set of struts 212. An extension lower crossbar (not shown) is supported by struts 210. A flexion lower crossbar (not shown) is supported by struts 212. Extension cable 214 is configured to pass through the upper extension crossbar and attach to the lower extension crossbar. A portion 218 of the extension cable 214 is redirected by the upper extension crossbar towards the lower extension crossbar (e.g., by a pulley). The lower portion 218 of the cable 214 is affixed to a cable anchor on the lower extension crossbar. The cable anchor is mounted on bearings to enable rotation of the anchor. When a user extends the knee, the extension cable 214 applies a force to the lower extension crossbar to assist the user in extending the knee. A portion 220 of the flexion cable 216 is redirected toward the flexion lower crossbar by the upper flexion crossbar (e.g., by a pulley). The lower portion 220 of the cable 216 is affixed to a cable anchor on the lower extension crossbar. The cable anchor is mounted on bearings to enable rotation of the anchor. When a user flexes the knee, the flexion cable 216 applies a force to the lower flexion crossbar to assist the user in flexing the knee. In some implementations, the flexion cable 216 is replaced with a spring affixed to the flexion upper crossbar and the flexion lower crossbar. Each of the extension cable 214 and the flexion cable 216 include a cable housing. The cable housing retracts from the edge of the inner cable when the cable 214 is in tension, as shown in inset 226 and inset 228. The portion 218 of cable 214 includes the inner cable only. Similarly, the portion 220 of cable 216 includes an inner portion only of the cable. Cable 214 and cable 216 can each be a Bowden cable that is capable of extension.

The first portion 202 of the frame and the second portion 204 of the frame are coupled by a joint device 222. The joint device 222 couples the first portion 202 to the second portion so that the portions can rotate relative to each other. The joint device 222 can include a pin joint, pulley system, etc. The joint device 222 is described in more detail with respect to FIGS. 5, 12, and 13A-13D. Diagram 102*c* of FIG. 2 shows the first portion 202 and the second portion 204 of the frame being decoupled from one another. Portions of the joint device 222 are shown as a first portion 222*a* and a second portion 222*b* on the first portion 202 of the frame and the second portion 204 of the frame, respectively. The joint device 222 is configured to be collocated (e.g., next to, nearby, in-line with, etc.) the knee of the user.

Diagram 230 shows forces on a user's leg caused by straps 224*a*, 224*b*, 224*c*, and 224*d* of the exoskeleton device 200. The straps 224*a-d* are configured to affix the exoskeleton device 200 to the user 112 and provide normal forces to the leg of the user to minimize slippage of the exoskeleton device on the user's leg and maximize user comfort. The straps 224*a-d* are configured to affix the exoskeleton device 200 to the user at the upper thigh, the lower thigh just above the knee, the calf, and the ankle, respectively. The ankle strap 224*d* and knee strap 224*c* locations are located as far from each other as possible, maximizing their leverage about the knee and minimizing forces applied to the user for a given knee torque. The same is true of the two thigh strap 224*a-b* locations. The upper thigh strap 224*a* can be connected to a belt at the waist or suspenders at the shoulders to prevent downward migration of the device.

The forces shown by arrows in diagrams 102*a*, 102*b*, and 102*c* are shown in a configuration when the axis of rotation of the knee joint is approximately aligned with that of the exoskeleton device 200 joint 222 and forces at the straps act normal to the user. Compression applied on the crossbar by the Bowden cable conduit and tension in the inner Bowden cable are equal and opposite resulting in a moment about the knee joint, shown in insets 226, 228, and 232. No net force is exerted by the exoskeleton device 200 on the leg in the world reference frame 102*a*. A free body diagram of the upper section of the exoskeleton device 200 shows one possible set of reaction forces: the reaction force at the joint bearing acts opposite to the tension in the inner Bowden cable and the forces applied by the exoskeleton straps are equal and opposite and act normal to the user's leg in diagram 102*c*. The forces represented here are approximations; small shear forces at the straps are expected, but difficult to quantify.

In some implementations, the frame of the exoskeleton device 200 is an aluminum material and/or a carbon fiber material. Similar materials can be used for construction of the frame. Each of the crossbars and the joint device 222 can be formed from aluminum and similar such materials.

For the purposes of diagrams 102*a*, 102*b*, and 102*c*, only knee extension torques are being applied. There is a tension in the extension rope on the anterior side of the leg and the flexion rope is slack. In diagram 102*a*, resultant forces act on the user's leg. The exoskeleton interacts with the user at four straps 224*a-d*. The straps 224*a-d* are configured to interact with the user at the top of the thigh, above the knee, above the calf muscle, and just above the ankle. In diagram 102*b*, forces in the Bowden cable conduit and inner rope (inset 232) are equal and opposite, producing no net external load on the leg. In diagram 102*c*, the complete exoskeleton device 200 experiences external loads at each of the four straps 224*a-d*. In diagram 230, the first portion 202 (e.g., thigh portion) forces and second portion 204 (e.g., calf section) forces are shown. In this example, the cable 214 tension and joint 222 reaction forces are equal and opposite.

Figure 3:
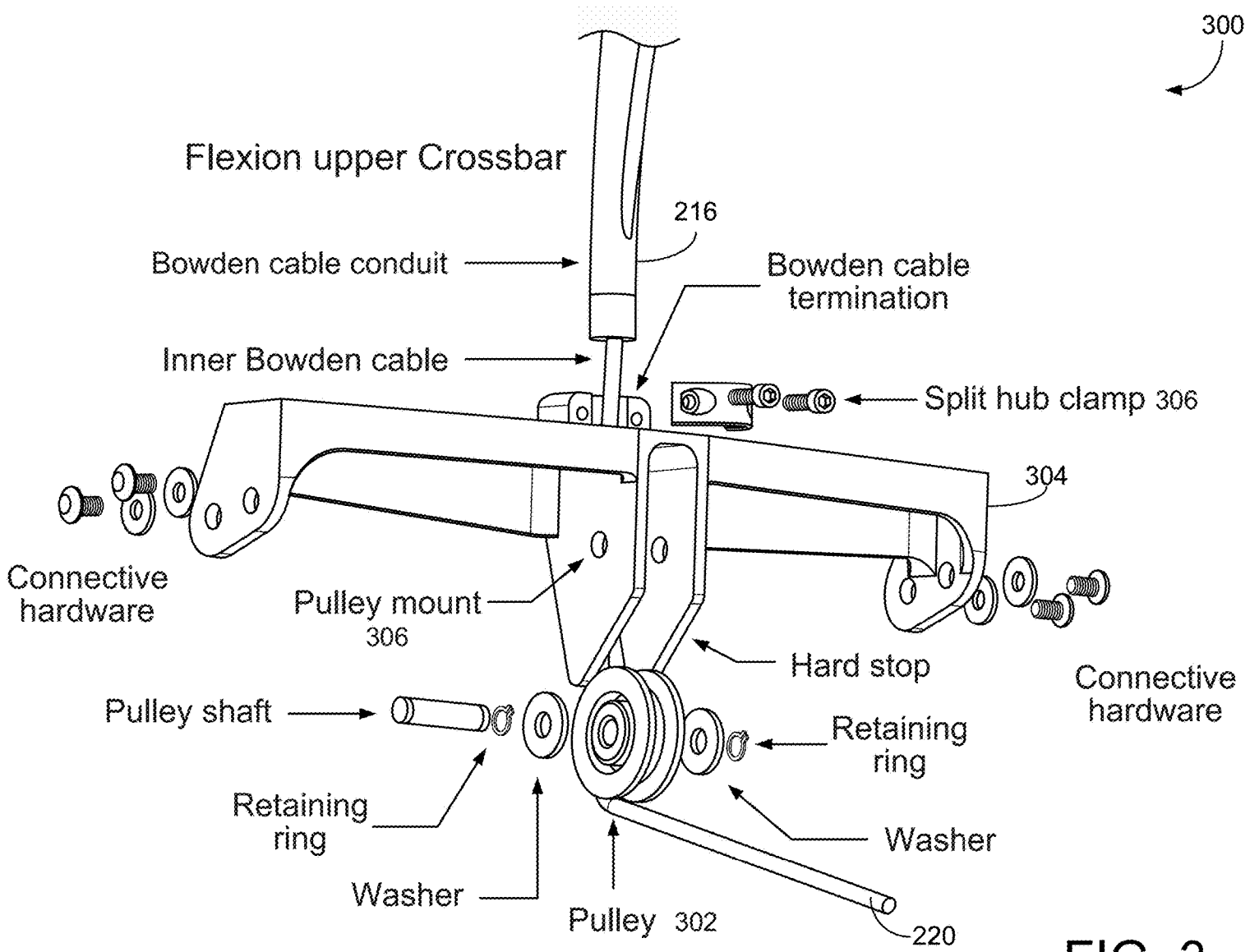
FIGS. 3-4 show examples of crossbars of an exoskeleton device.

On the first portion 202, each of the sets of struts 206, 208, 212, and 214 include a lateral strut and a medial strut. As stated earlier, since the view of FIG. 2 is from the side, only the medial strut of each set is shown. The lateral and medial struts are each connected by an aluminum crossbar with cable housing terminations. Turning to FIG. 3, an example of an upper flexion crossbar is shown. In this case, crossbar 300 is supported by struts 206 of FIG. 2. The inner cable portion (e.g., portions 218, 220 of cables 214, 216, respectively) extends from each upper crossbar 300 to cable anchors mounted on each lower crossbar of the second portion 204. An example lower crossbar is described in reference to FIG. 4.

Figure 4:
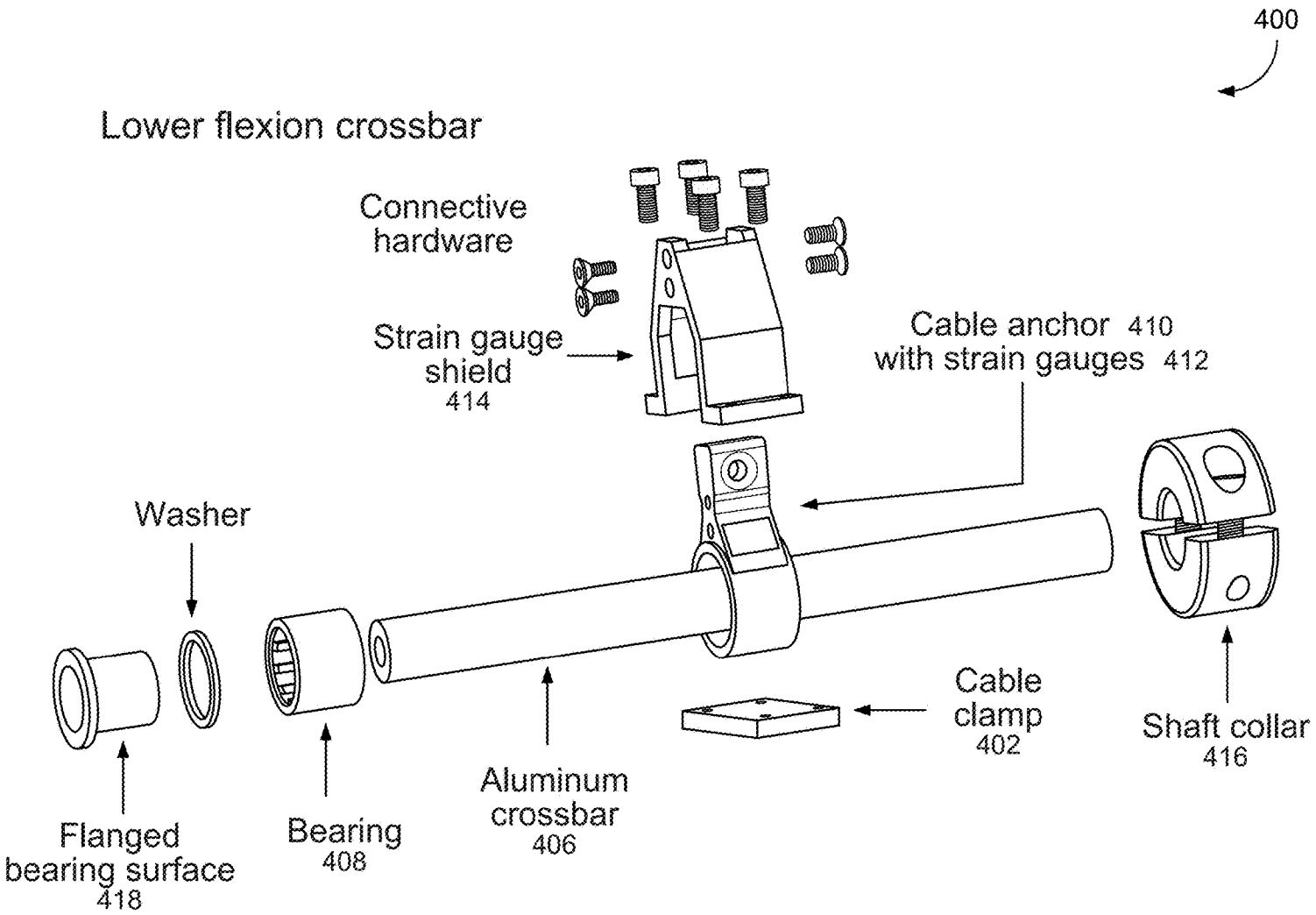

The upper crossbar 300 includes a pulley 302 configured to redirect the inner cable portion 220 toward the lower crossbar (crossbar 400 of FIG. 4). The pulley is mounted on a pulley mount 306 that enables the pulley to freely spin without inhibiting the cable 216. The cable 216 housing terminates at the clamp 306. A rigid bar 304 is fastened to struts (e.g., struts 206 of FIG. 2) to fix the crossbar 300 to the first portion 202 of the exoskeleton device 200.

Turning to FIG. 4, an example of a lower flexion crossbar 400 is shown. The crossbar 400 can be mounted to the frame of the exoskeleton device 200 by struts 212 of FIG. 2. The lower crossbar 400 includes a cable clamp 402 for assisting in fastening the cable 220 to the lower crossbar 400. The crossbar 400 includes a rigid lateral bar 406. The bar 406 can rotate relative to the frame of the exoskeleton device 200. The bar 406 is mounted on a bearing 408 which enables rotation of the bar 406. The bearing 408 works in tandem with a shaft collar 416 and a flanged bearing surface 418. A cable anchor 410 is affixed to the bar 406 and can rotate along with the bar. The cable anchor 410 includes sensors, such as strain gauges 412, to measure forces of the cable 220 on the lower crossbar 400. The cable 220 is routed through the anchor 410 such that tension on the cable 200 is applied to the anchor and the sensors 412. The forces measured by the sensors 412 are sent to the controller 108 to enable closed loop control of the exoskeleton device 200. A shield 414 can protect the sensors from other external forces. The anchor 410 can be aluminum. The anchor is mounted on bearings 408 to prevent torsional loads on the crossbar 400. Tension in the cable 214 located on the anterior side of the leg generates extension torques while tension in the posterior cable 216 generates flexion torques.

The aluminum crossbars 300, 400 are of varying length with the longest at the thigh and the shortest above the ankle. Crossbars of different sizes can be exchanged to adjust the fit. The planar carbon fiber struts 206, 208, 210, 212 accommodate these changes in width with low stiffness in the frontal plane. The struts 206, 208, 210, 212 can be exchanged to fit users with shank lengths ranging from 0.42 to 0.50 m and thigh lengths ranging from 0.38 m to 0.46 m. The exoskeleton accommodates knee angles ranging from straight leg to 120 degrees of flexion and can apply 120 Nm of extension torque and 75 Nm of flexion torque limited by frame strength. These values correspond to the range of motion and peak torques observed at the human knee during unaided running.

Figure 5:
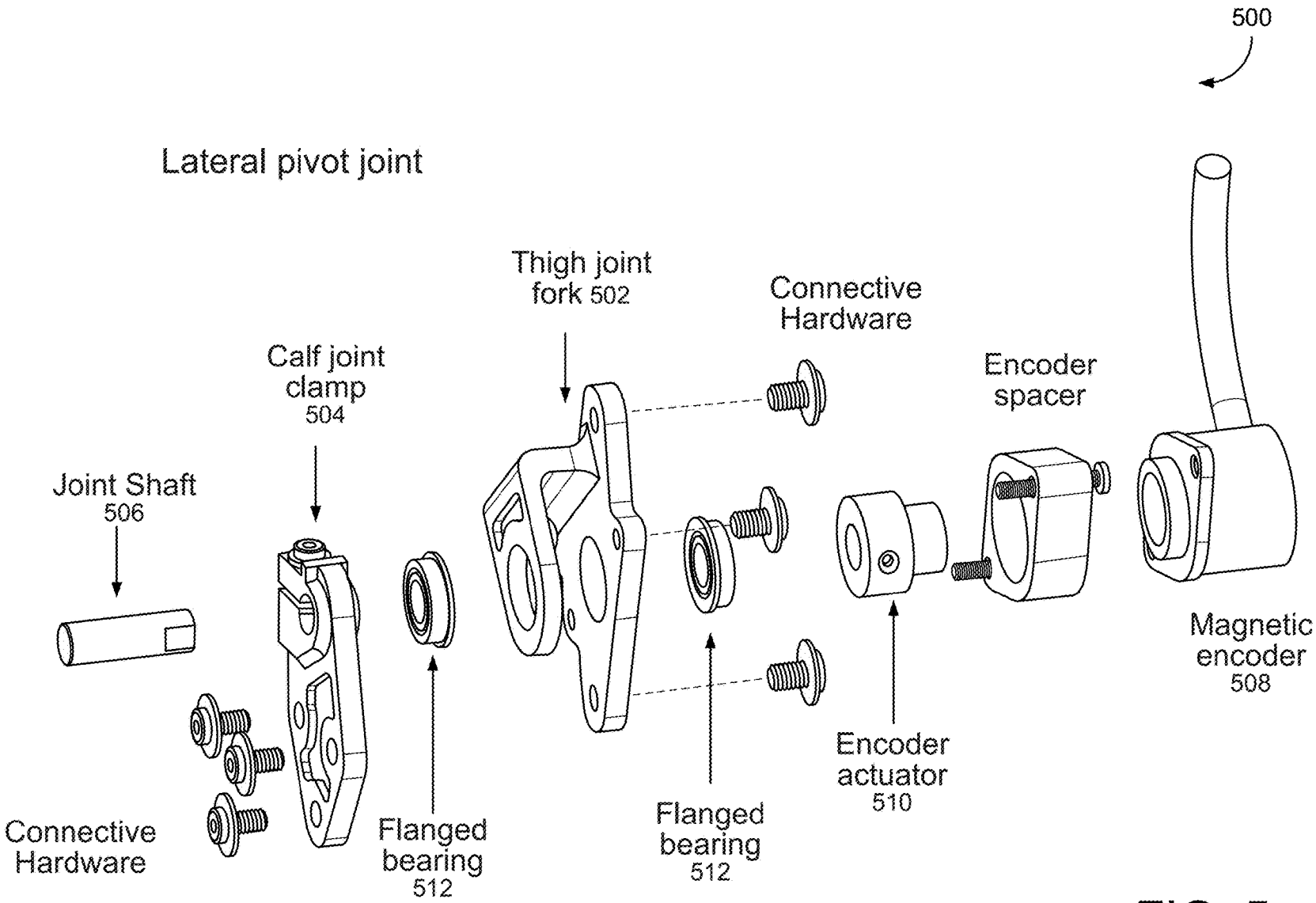
FIG. 5 shows an example joint of an exoskeleton device.

FIG. 5 shows an example of a joint device 500. A thigh joint fork 502 (e.g., corresponding to joint 222*a* of FIG. 2) is coupled to a calf joint clamp 504 (e.g., corresponding to 222*b*). In some implementations, the thigh joint fork 502 is affixed to the first portion 202 of the frame of FIG. 2. The calf joint clamp 504 is affixed to the second portion 204 of the frame of FIG. 2. A rigid joint shaft 506 couples the thigh joint fork 502 to the calf joint clamp 504. An encoder 508 measures the amount of rotation of the thigh joint fork 502 around the joint shaft 506. The encoder 508 is paired with an encoder actuator 510 to measure the amount of rotation. Bearings 512 facilitate rotation of the fork 502 and clamp 504 around the joint shaft 506. While a particular joint 500 is shown, other joints (e.g., shown in FIGS. 12 and 13A-13D) can be used to enable rotation of the first portion 202 of the frame with respect to the second portion 204 of the frame. The shared axis of rotation of these joints is approximately co-linear with the human knee joint.

In some implementations, a flexion crossbar 400 connects the medial and lateral frame stays of the thigh section. A Bowden cable housing terminates in the center of the crossbar. The housing is secured in a split hub clamp. The inner Bowden cable extends through the crossbar and is redirected as knee angle changes by a pulley mounted inside the safety hard stop. The extension crossbar has similar features.

In some implementations, the lower flexion crossbar connects the medial and lateral frame stays of the calf section. The inner Bowden cable is secured on the aluminum cable anchor. The cable anchor is instrumented with four strain gauges in a Wheatstone bridge configuration for sensing tension in the cable. The strain gauges are protected by a plastic shield that is secured to the cable anchor. The wires extending from the strain gauges are clamped between a plastic plate and the strain gauge shield for strain relief. The aluminum cable anchor is mounted on a bearing in order to prevent torsional load from being applied to the aluminum crossbar. The bearing sits on a steel bearing surface that is secured to the crossbar with epoxy. Translation of the bearing along the length of the crossbar is resisted by a flange on the steel bearing surface and by a plastic shaft collar.

In some implementations, a pivot joint is composed mainly of two aluminum components, the thigh joint fork and the calf joint clamp. The thigh joint fork connects to the thigh frame struts and provides a stable double shear connection with two ball bearings and a mounting point for the rotary encoder. The calf joint clamp connects to the calf frame struts and features a split hub clamp for rigidly attaching to the joint shaft.

In some implementations, the exoskeleton frame struts 206, 208, 210, 212 can be manufactured from plate carbon fiber on a water jet cutter. Aluminum tubes cut from stock lengths can be used as crossbars 406 the lower lever arms. The ends of the tubes are threaded for attachment to the frame struts 210, 212. The joint components, Bowden cable terminations and pulley mounts for the upper crossbars include CNC machining of 7075 aluminum.

Knee angle is sensed using a magnetic encoder (RM221, Renishaw Inc., Hoffman Estates, IL, USA) and foot contact with heel switches (7692K3, McMaster-Carr, Cleveland, Ohio, USA) located inside the user's shoe. Tension in the Bowden cables is sensed using two sets of four strain gauges (KFH-3-350-D16-11L3M2S, OMEGA Engineering, Stamford, Conn., USA) in Wheatstone-bridge configurations located on the aluminum rope anchors. Bridge voltage is sampled at 5000 Hz and low-pass filtered at 200 Hz to reduce the effects of electromagnetic interference. Torque is geometry dependent and is calculated in real time using measurements of both cable tension and knee angle. A combination of classical proportional control with damping injection and iterative learning is used to control exoskeleton torque.

Figure 6:
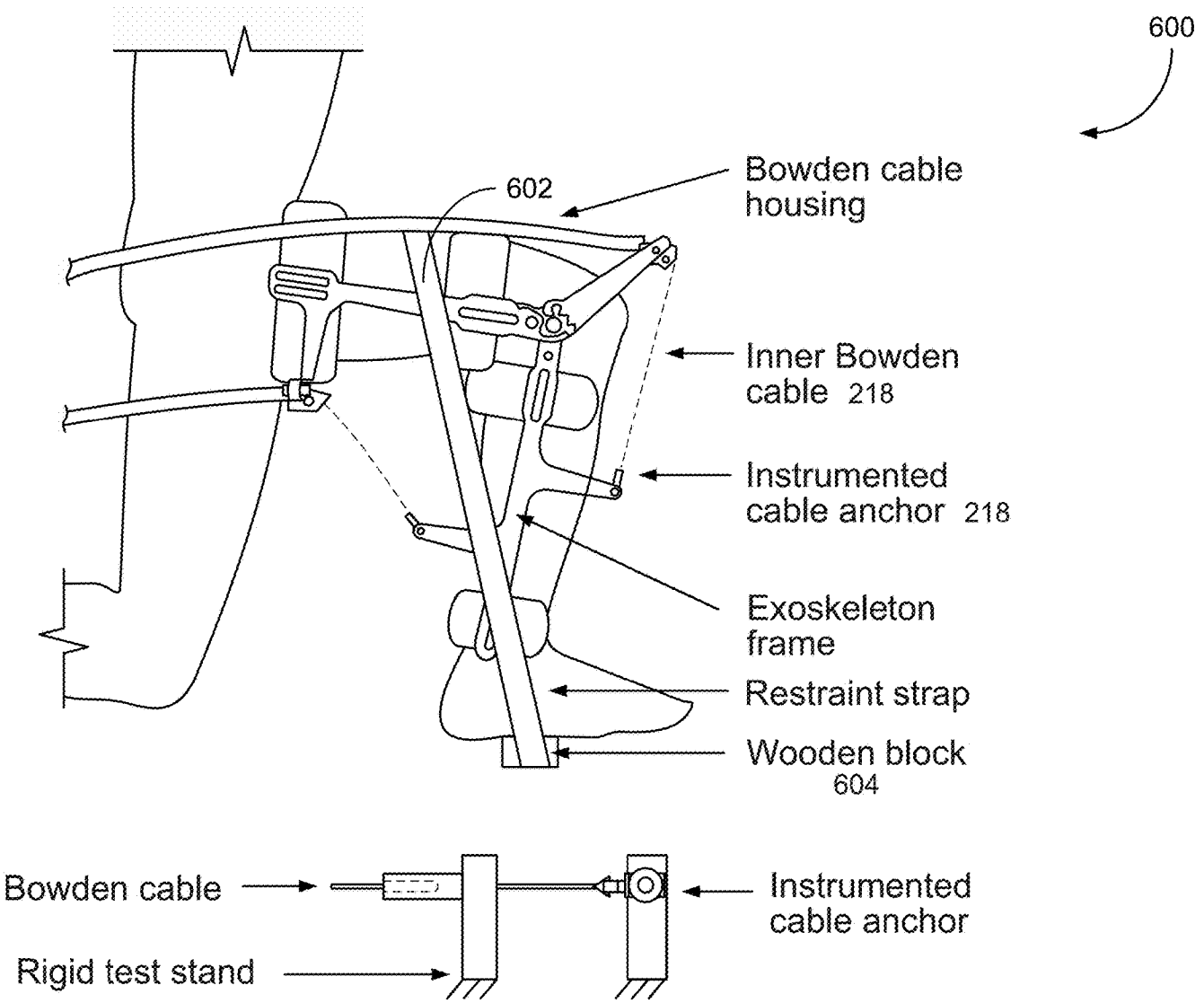
FIG. 6 shows an example exoskeleton device attached to a user.

In tests of torque measurement accuracy, the aluminum cable anchors and supporting crossbars were removed from the exoskeleton and secured on a rigid test stand. Force was incrementally increased by hanging weights of known mass from the Bowden cable. For the closed-loop bandwidth tests, steps in applied torque lasting 3 seconds were applied in both low (1745 N) and high force (436 N) settings. These forces are equivalent to the forces required to apply 20 Nm and 50 Nm of torque to the user's knee while wearing the device in a straight leg configuration. Testing of the exoskeleton device 200 was performed using a testbed 600 shown in FIG. 6. A bandwidth test setup on human subject is shown in testbed 600. The user's knee was restrained by a strap 602 that wrapped over the user's thigh and attached to a block 604 under the foot. This prevented the knee from extending during the test. The bandwidth test setup was on a rigid test stand. An instrumented cable anchor and carbon fiber crossbar were removed from the exoskeleton and mounted on a rigid test stand.

The exoskeleton device 200 is capable of providing positive work with large torques during walking and is configured to cause metabolic reductions in the user. The magnitude of torques applied that resulted in the largest metabolic reductions corresponded to about 60 to 80% of the torque produced at the ankle during normal walking. Therefore, we are particularly interested in exploring torque at the knee at and above 20 Nm as it corresponds to approximately 65% of the peak torques produced at the knee during normal walking for an average-sized subject. A 50 Nm benchmark was selected to allow for comparison to an ankle exoskeleton emulator described in U.S. Pat. Application Pub. No. 2017/0340506 and U.S. Pat. Application Pub. No. 2018/0125738, the contents of each being incorporated in entirety herein.

Closed-loop bandwidth tests were performed both while worn by a user and on the rigid test stand. Bandwidth tests were performed by applying a series of sinusoidal desired torque trajectories two seconds in length with a one-second pause in between trials. The first sinusoidal signal for desired torque was commanded at 1.0 Hz and the frequency of each successive trail was increased by 1.0 Hz until a frequency of 55 Hz was reached. For the low torque bandwidth test the desired sinusoidal signal had minimum and maximum values of 10 and 20 Nm. For the high torque trials, the peak torque was 50 Nm with a minimum torque of 10 Nm. Each of these tests were performed ten times and the results were averaged. Bode plots were generated by fitting the applied and measured torque signals to sinusoids described by A sin(Bx+C) where A is the amplitude of the sine wave, B is the period, and C is the phase offset, assuming the frequency of the commanded and measured waves are equal. The magnitude of the frequency response was calculated in decibels as $20 \cdot \log_{10}(Am*Ad)$ where Am is the amplitude of the sinusoid fitted to the measured data and Ad is the amplitude of the desired torque signal. The phase shift between the desired and measured signals was calculated as (Cd−Cm).

The same methods were applied for bandwidth tests performed on the exoskeleton device 200 while worn by a user. For the low torque bandwidth test, the maximum and minimum values of the desired torque were 20 and 10 Nm. For high torque trials, the peak torque was 50.0 Nm with a minimum of 20 Nm. These torques were commanded while the knee was positioned at roughly 90 degrees so that the force used to generate the torque was approximately the same as the force used in the bandwidth tests on the rigid test stand. The highest frequency tested while the exoskeleton was worn by a user was limited to 23 Hz by user comfort. During these tests, the user's leg was restrained by a strap that wrapped over the knee and under the toe, as described above in reference to FIG. 6. The high and low torque tests on a human user were each performed five times and the results averaged.

Figure 7:
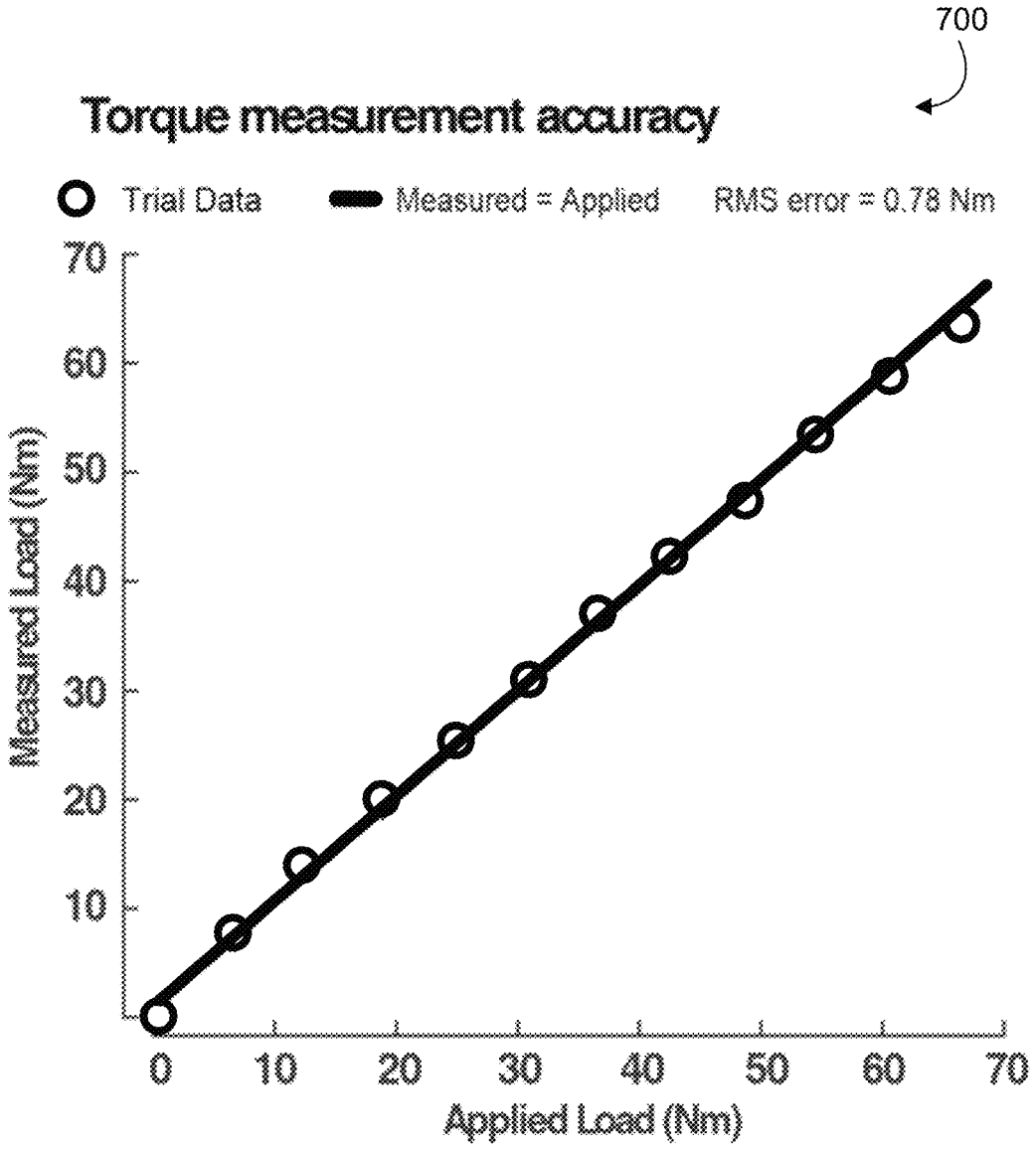
FIG. 7 shows data representing torque measurement accuracy for an example exoskeleton device.

The mass of the knee exoskeleton is 0.76 kg. The device allows a range of motion from straight leg at 0° to 120° of knee flexion. Force measurement accuracy tests showed RMS error of 6.14 N which corresponds to 0.78 Nm of torque with the exoskeleton in a straight leg configuration. FIG. 7 shows a graph 700 reporting this relationship. Torque measurement calibration results demonstrate an RMS error of 0.78 Nm with a maximum load of 63 Nm.

Figure 8:
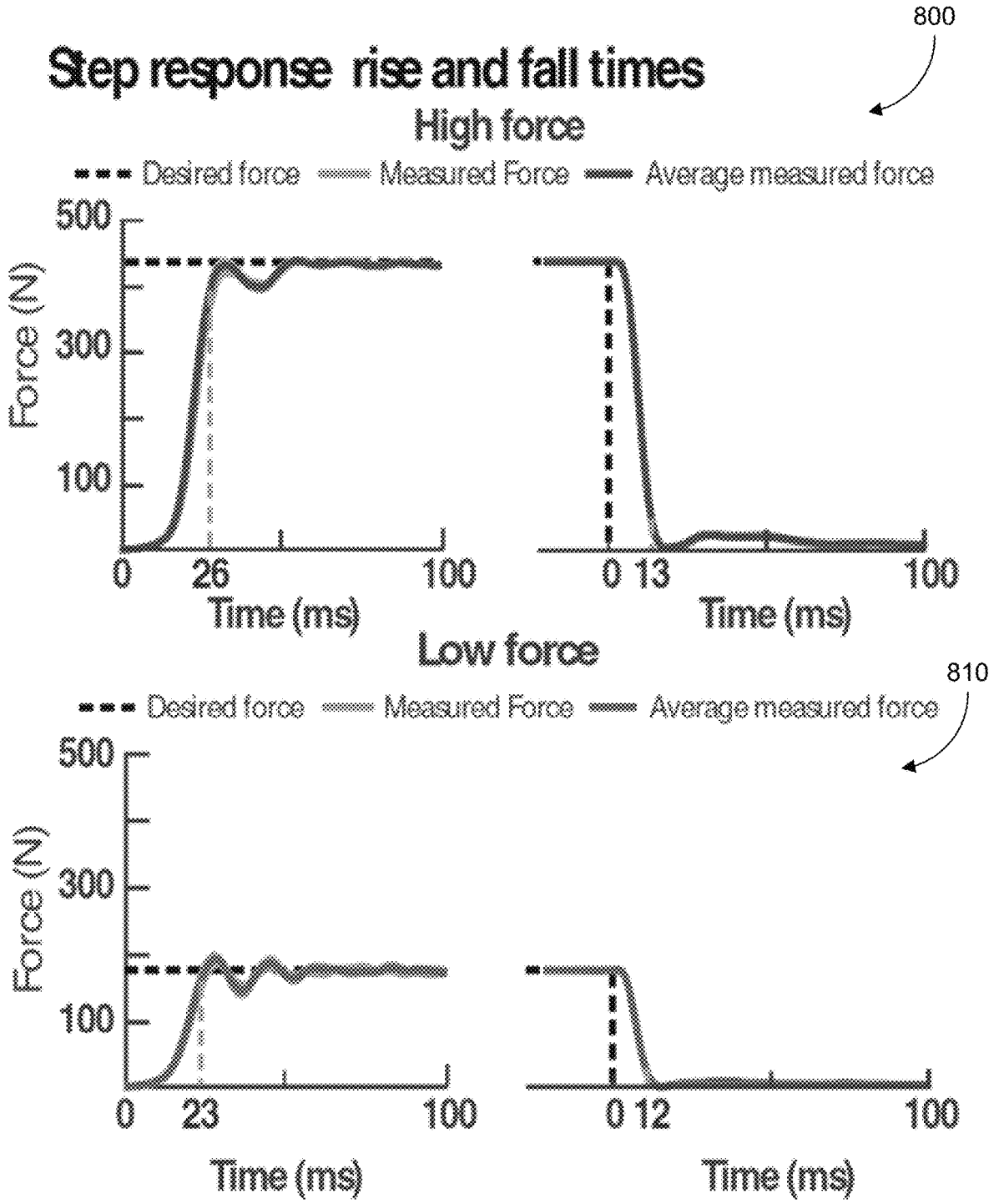
FIG. 8 shows data representing step responses for an example exoskeleton device.

Turning to FIG. 8, graph 800 shows results of step response tests. The step response tests showed a rise time of 0.023 s for the low torque (20 Nm) trials and 0.026 s for the high torque (50 Nm) trials. Graphs 810 show low force test data and graph 800 shows high force tests data. Step response was performed at both low (graph 800) and high (graph 810) force. The low force test was conducted at 175 N (corresponding to 20 Nm of torque on the knee exoskeleton in a 90° configuration) with rise time of 0.023 seconds. The high force step-response test was conducted at 436 N (corresponding to 50 Nm of torque on the knee exoskeleton in a 90° configuration) with a rise time of 0.026 seconds.

Figure 9:
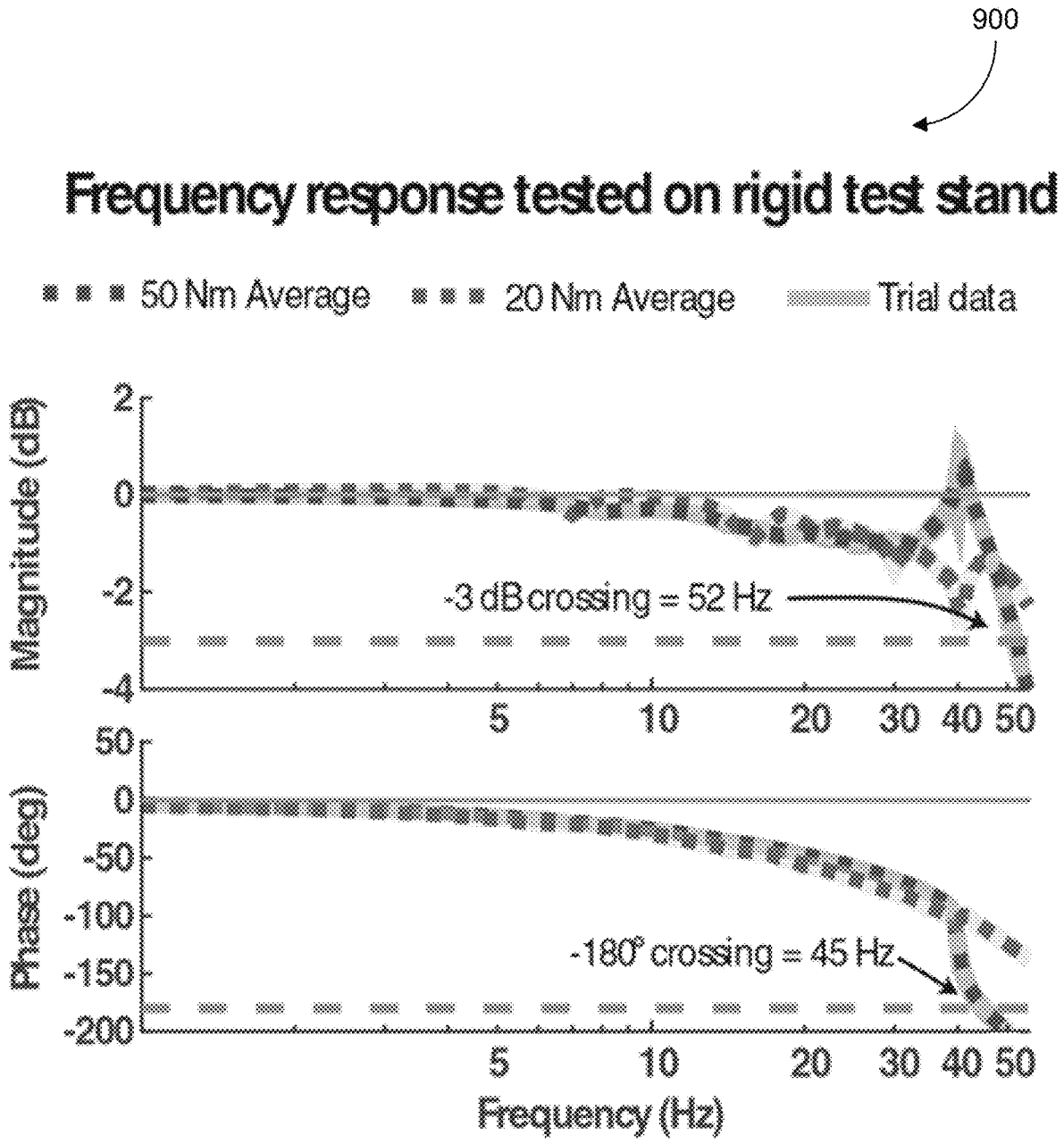
FIGS. 9-10 show frequency response data for an example exoskeleton device.

Turning to FIG. 9, graphs 900 show that the bandwidth of the combined exoskeleton and human system was phase limited at 23 Hz for both the low and high torque settings as measured by the 180° crossover. The bandwidth of the motor with force sensor fixed on a rigid test stand was phase limited at 45 Hz in the high torque setting and gain limited at 52 Hz as measured by the −3 dB crossing in the low torque setting. Bandwidth was tested on a rigid test stand for both high (50 Nm maximum) and low torque (20 Nm maximum) settings. The bandwidth was phase-limited at 45 Hz as measured by the −3 dB crossover.

Figure 10:
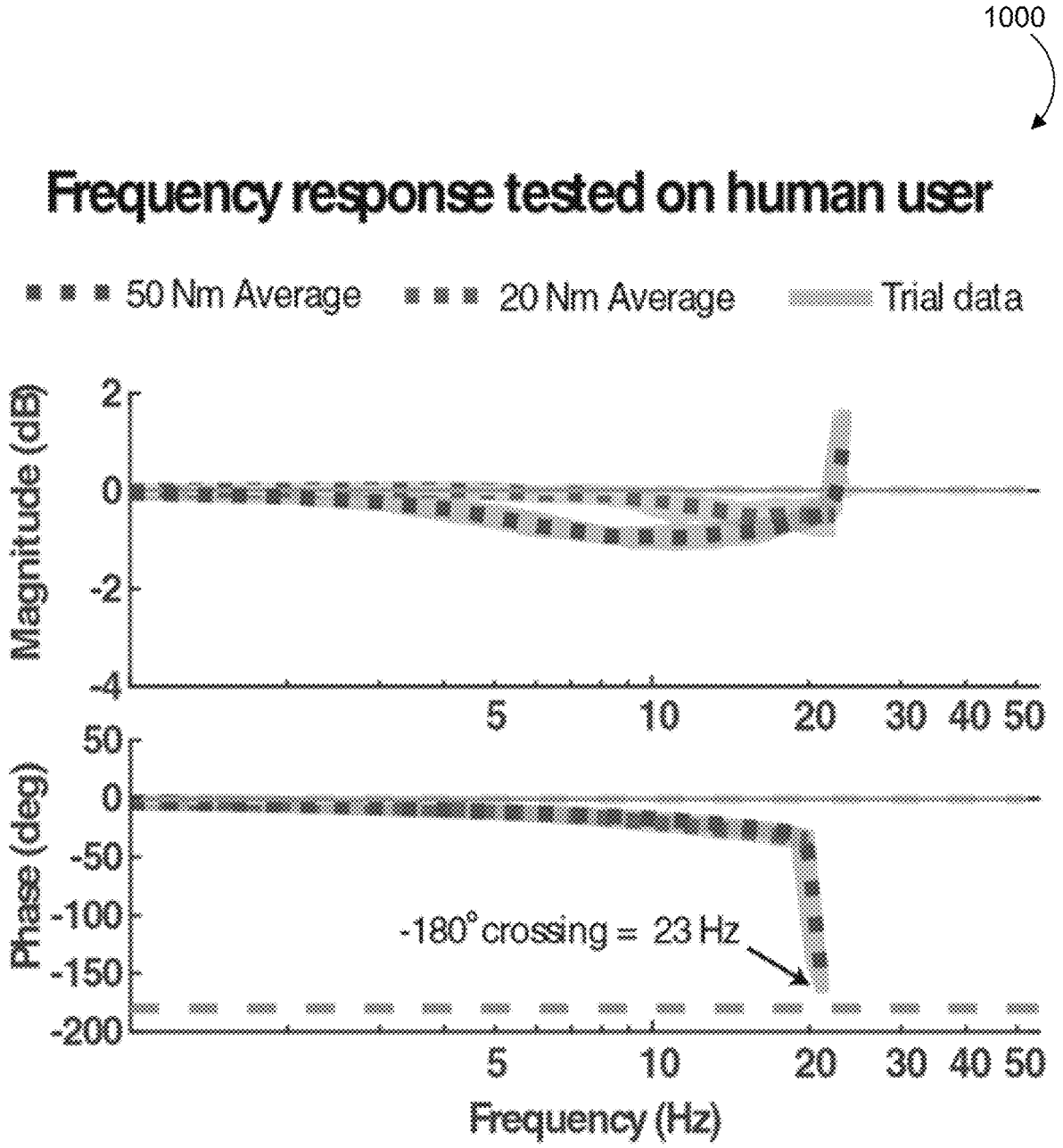

Turning to FIG. 10, graphs 1000 show bandwidth tests performed on a human user for both high (50 Nm maximum) and low (20 Nm maximum) torque settings.

Figure 11:
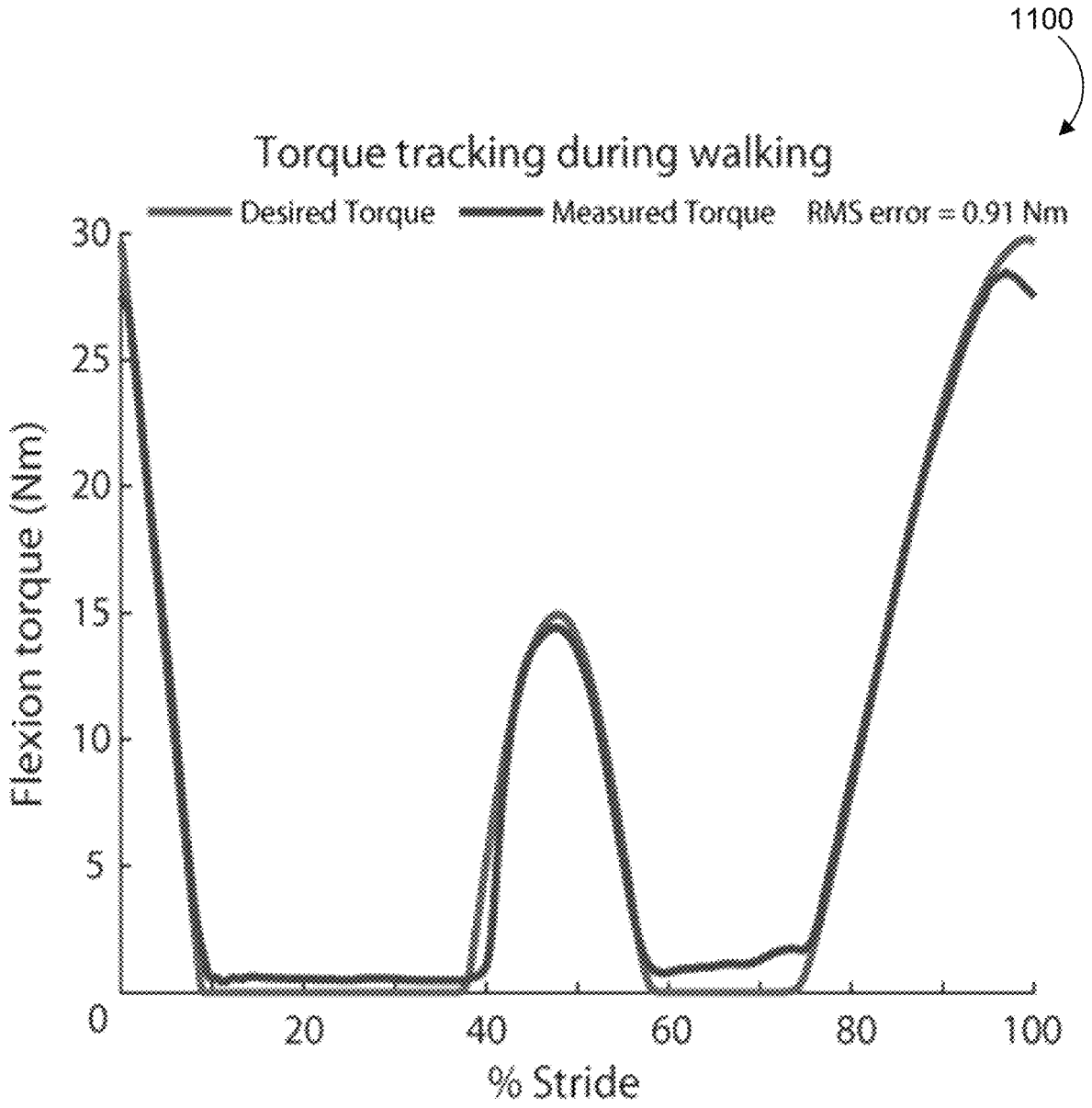
FIG. 11 shows data representing torque control for an example exoskeleton device.

FIG. 11 shows a graph 1100 torque tracking that was evaluated during 100 strides. The average RMS error over a stride was 0.91 Nm. The average desired and measured flexion torque are shown from 100 steps of walking at 1.25 m/s.

During the gathering of this data of graph 1100 (in addition to data collection for graphs 700, 800, 810, 900, and 1000), the four straps proved to be insufficient to prevent downward migration of the exoskeleton. Adding suspenders between the thigh strap and the shoulders or connecting to a belt at the waist were both effective methods of securing the exoskeleton. The waist belt is a common solution and was connected to the thigh strap with an additional length of webbing on the lateral aspect of the hip where the distance to the exoskeleton changed little during hip flexion and extension. Inextensible webbing was used for the leg straps and we found that the lower thigh strap and calf strap became too tight at large angles of flexion and too loose at straight leg due to changes in muscle volume. As a result, the calf strap needed to be loosened for comfort and was no longer sufficient to prevent downward migration. This was not the case for the ankle exoskeleton that has a single strap at the calf.

Many exoskeletons feature a series elastic element to improve torque control or to allow for smaller actuators. Adding series elasticity can help improve disturbance rejection usually at the cost of lower bandwidth. This exoskeleton was not originally designed for series elasticity as it was expected that compliance in the vectran cable and the user's soft tissues would be sufficient. However, it was found that a compliant elastic cord added on the device side of the Bowden cable helped to correct torque-tracking errors caused by stiction in the Bowden cable.

The joint 222 (e.g., joint 500 of FIG. 5) design of this exoskeleton make it lightweight, inexpensive and simple to design and manufacture. Flexion and extension is actively controlled by the exoskeleton and is allowed by the explicit rotary joint 500. Small displacements in the other five degrees of freedom are allowed through high compliance in uncontrolled directions. The user's soft tissues are very compliant. The exoskeleton can be easily shifted by 30 mm up and down or twisted around the leg by about 8 degrees by lightly lifting with a single finger on each side of the exoskeleton before resistance increases significantly. The low stiffness of the knee exoskeleton frame in the varus/valgus direction allows for some variability, but the knee exoskeleton is difficult for individuals with a high degree of valgus rotation due to limited clearance between the exoskeleton and the contralateral limb. Adding asymmetric spacers between the leg and the frame struts to shift the exoskeleton medially or laterally can help with fitting. An explicit degree of freedom for varus/valgus rotation would make fitting the exoskeleton to users easier. Overall, high compliance in our exoskeleton allows for comfortable use.

Several more complicated exoskeleton designs address the multiple degrees of freedom of the knee. A four bar linkage (not shown) has been developed to more closely approximate the moving center of rotation of the knee. However, this solution faces the same issues as a revolute joint if the exoskeleton migrates down the leg and becomes misaligned with the human joint. A six-degree of freedom knee exoskeleton that takes advantage of rotary joints and articulated parallelograms delivers a pure moment to the user. This exoskeleton should be comfortable and fit a wide range of subjects, but at the cost of complexity and mass.

Figure 12:
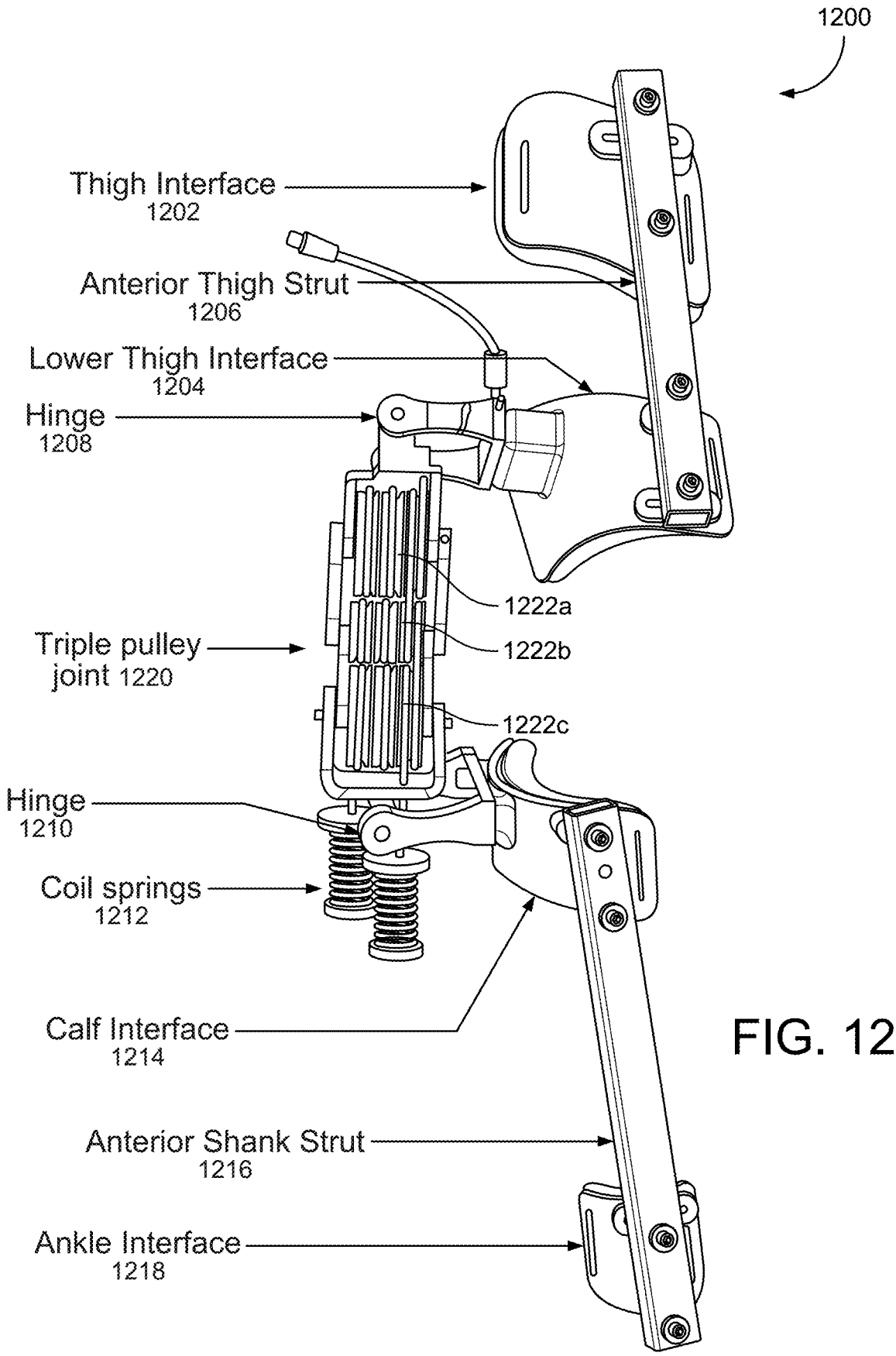
FIG. 12 shows an example joint for an exoskeleton device.

Alternative to the joint 500 of FIG. 5, a knee exoskeleton end-effector with a five degree of freedom joint 1200 was developed, shown in FIG. 12. Joint 1200 accommodates the multiple degrees of freedom of the human knee joint. A five-degree-of-freedom exoskeleton device 200 joint 1200 provides a pure moment to the knee joint. All rigid components are located on the lateral or anterior side of the leg. The exoskeleton consists of four aluminum strap interfaces at the upper thigh 1202, lower thigh 1204, calf 1214, and ankle 1218 (e.g., similar to straps 224*a-d*). These interfaces are connected by rigid anterior struts 1206, 1216 (e.g., formed of rectangular carbon fiber tubes). The joint 1200 is composed of two hinges 1208, 1210 and three sets 1222*a*, 1222*b*, 1222*c* of three pulleys that allow for five degrees of freedom. The three sets 1222*a-c* of pulleys are used for flexion, extension, and an adjustable safety hard stop. One cable in the joint 1200 is used for extension, a second cable is used for flexion, and a third cable is used for a safety hard stop to prevent hyperextension. Stretch in the cables made measurement of joint angle difficult and reduced the effectiveness of the safety hard stop. The inner Bowden cables (cables 1230, 1232, 1234 described in relation to FIG. 13C) are used to apply extension and flexion torques wrap around these pulleys and terminate on compression coil springs that supply series elasticity.

The triple pulley configuration with double hinges can accommodate any joint motion other than internal and external rotation. No rigid components are placed on the medial aspect of the leg, which reduces hip circumduction during walking (e.g., relative to an exoskeleton device including rigid elements placed on the medial aspect of the leg). This joint configuration facilitates fitting the exoskeleton device 200 to a wide range of leg shapes and sizes.

Figure 13A:
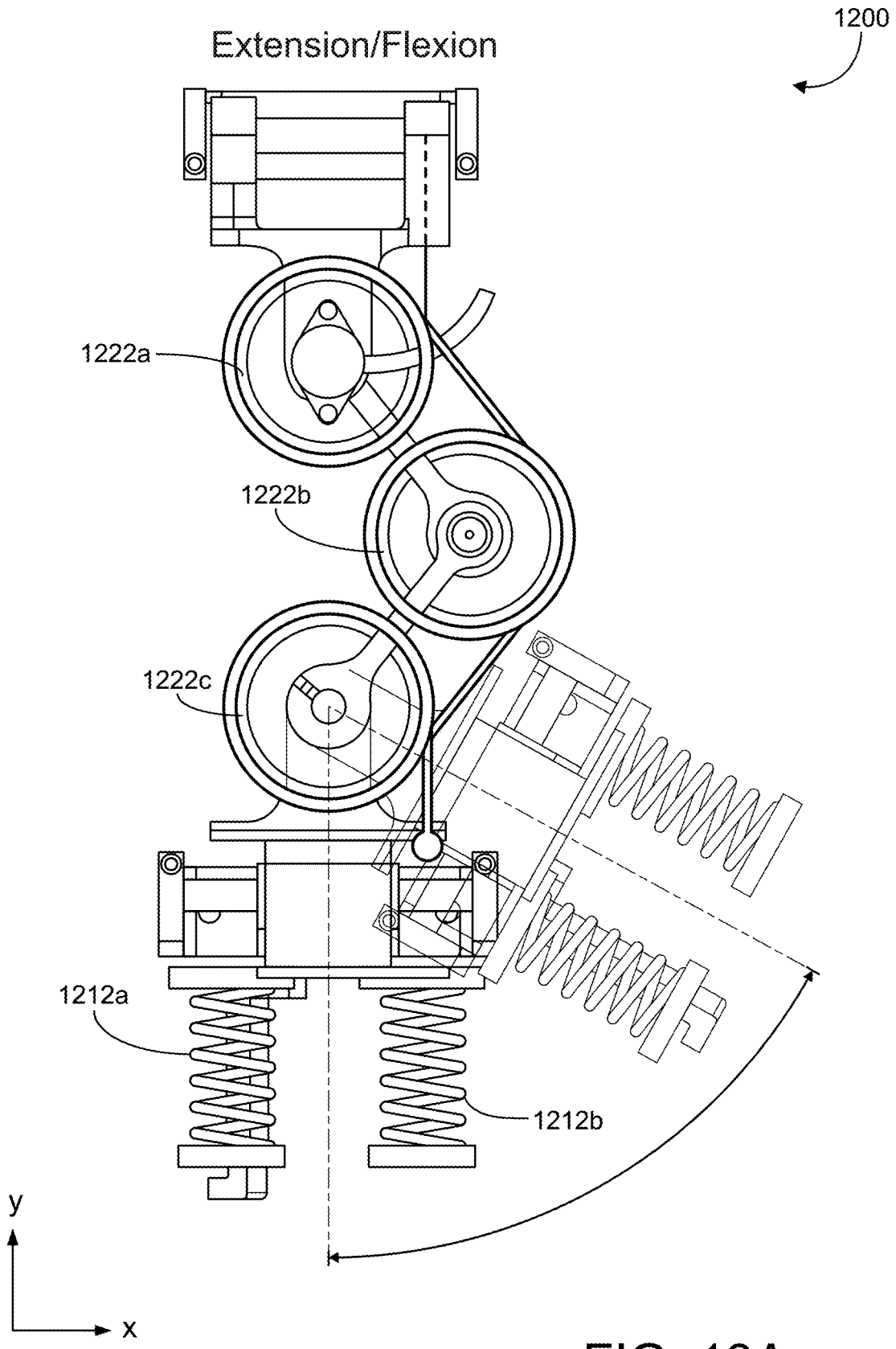
FIGS. 13A-13D show example views of a joint for the exoskeleton device.

FIG. 13A shows the joint 1200 from a side view that includes a visualization of motion of the joint along pulley set 1222*c*. Movement along this pulley set 1222*c* enables extension/flexion of the joint.

Figure 13B:
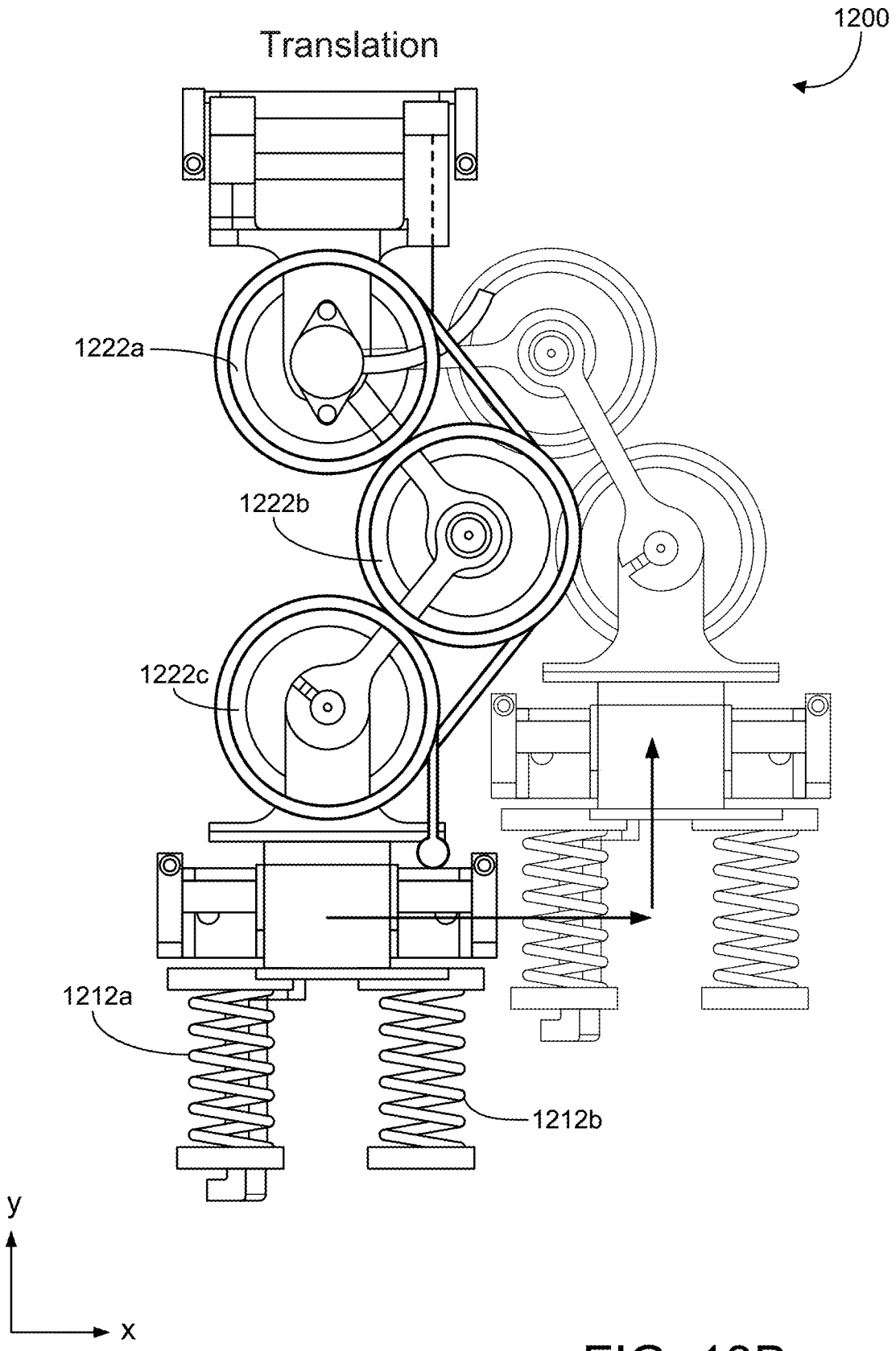

FIG. 13B shows the joint 1220 from a side view that includes a visualization of the joint along the pulley set 1222*a*. Movement along this pulley set is used for translation motion of the joint 1200. Translational movement can be assisted by springs 1212*a* and 1212*b*.

Figure 13C:
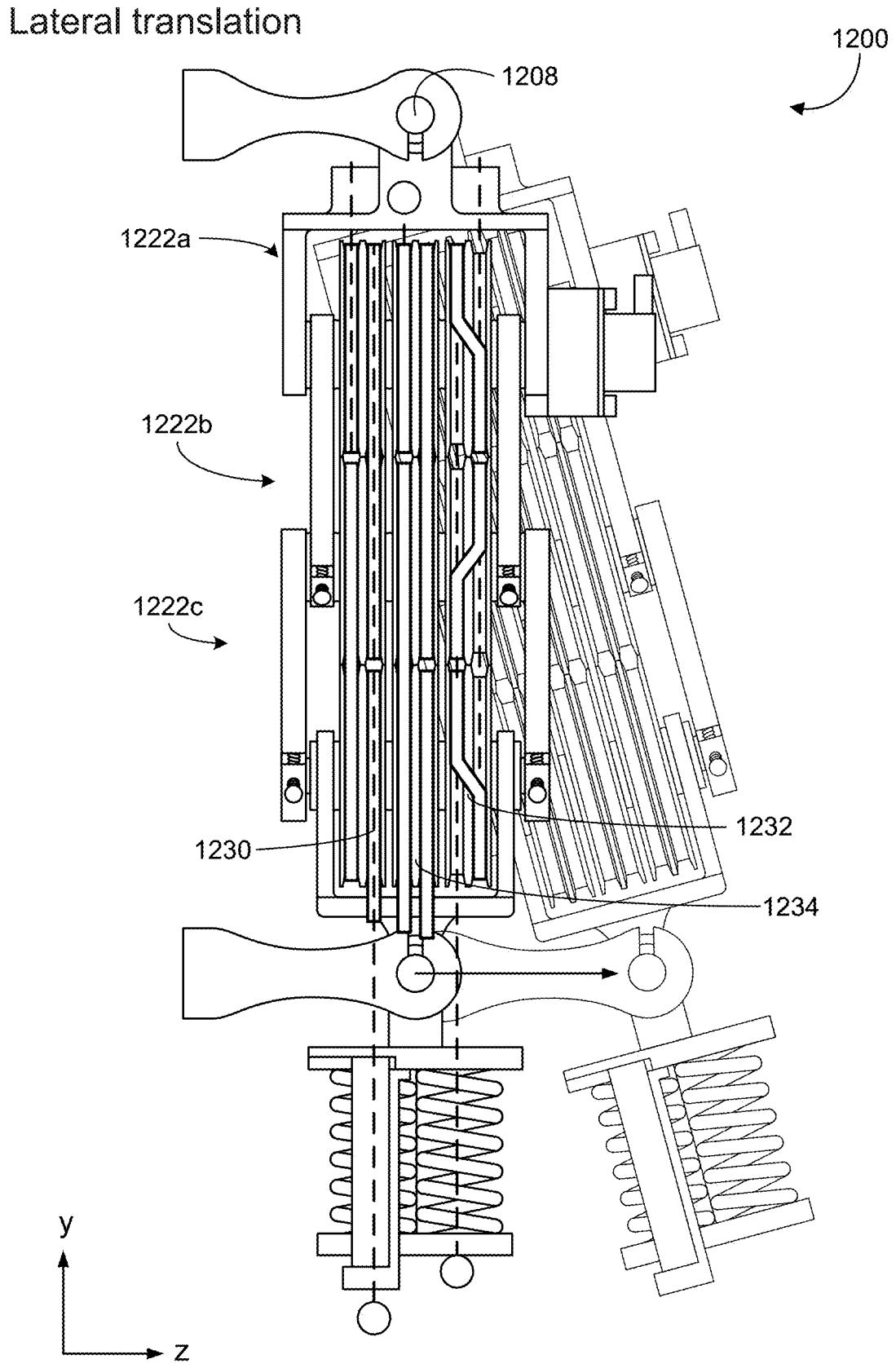

FIG. 13C shows the joint 1200 from a front view that includes a visualization of lateral translational movement of the joint by the hinge 1208. Cables 1230 and 1232 are used for extension and flexion motions. Cable 1234 is a fixed length cable used to prevent hyperextension. All three cables are interfaced with each pulley set 1222*a*, 1222*b*, 1222*c*. In some implementations, cables 1230, 1232 can be Bowden cables. In this example, pulley sets 1222*a-c* each have three pulleys, but additional pulleys can be added.

Figure 13D:
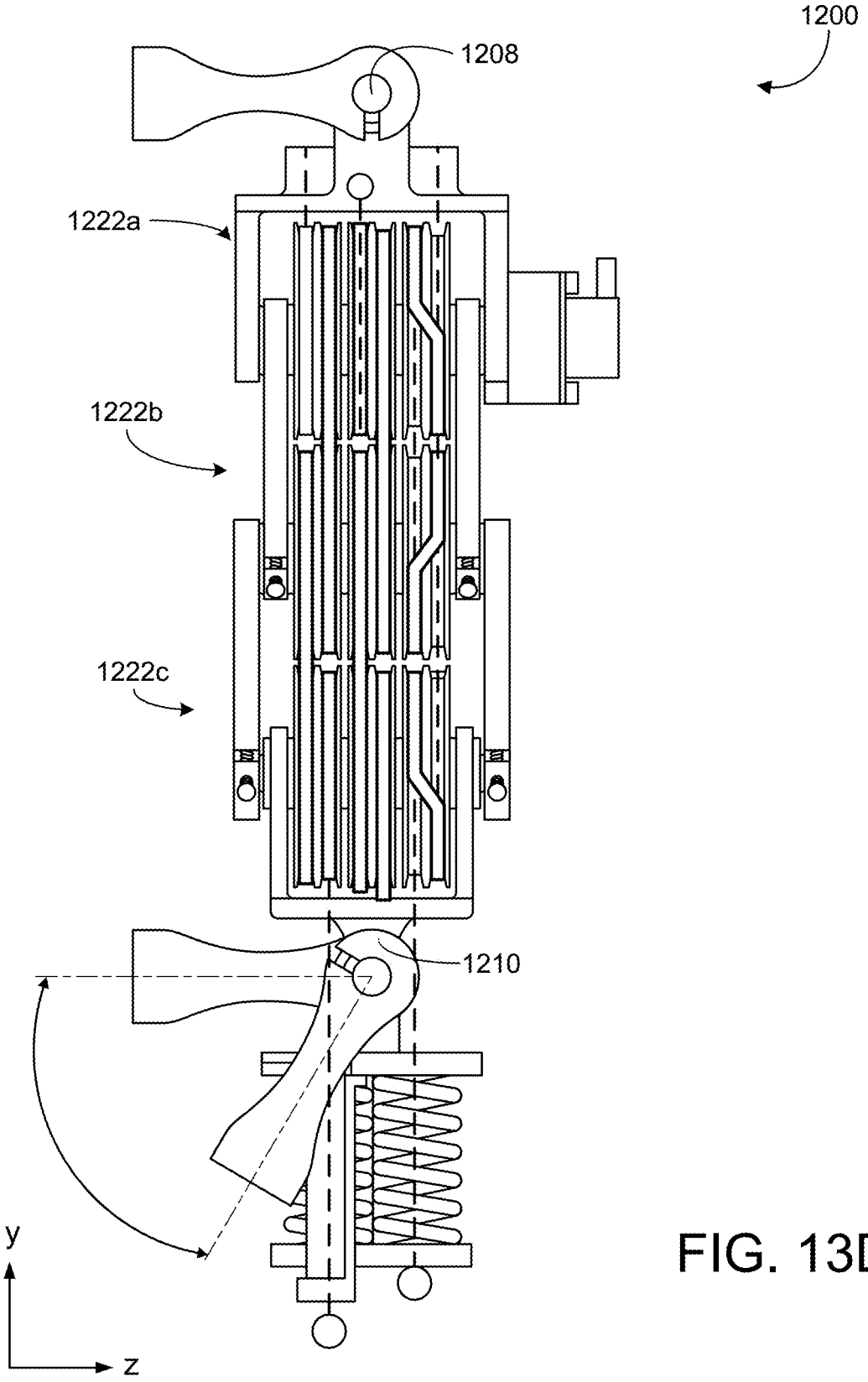

FIG. 13D shows the joint 1200 from a front view that includes a visualization of varus/valgus rotation using hinge 1210. The three pulley sets 1222*a-c* are shown. A cable 1232 is shown for extension/flexion movement. Though cables 1230, 1234 are not visible, those cables are present in this joint 1200.

A number of exemplary embodiments have been described. Nevertheless, it will be understood by one of ordinary skill in the art that various modifications may be made without departing from the spirit and scope of the techniques described herein.

What is claimed is:

1. An exoskeleton system, comprising:

a cable;

an exoskeleton device comprising:

a frame comprising a first portion coupled to a second portion by a joint;

a first crossbar supported between a first lateral strut and a first medial strut each extending from the first portion of the frame; and a second crossbar supported between a second lateral strut and a second medial strut each extending from the second portion of the frame;

wherein the first crossbar supports a pulley in a central portion of the first crossbar, the pulley being configured to redirect the cable toward the second crossbar, and wherein the cable is configured to be anchored to a central portion of the second crossbar and spaced from the frame by the first lateral strut and the first medial strut and the second lateral strut and the second medial strut, the cable being centered over the central portion of the first crossbar and the central portion of the second crossbar;

a motor that is connected to the cable and configured to cause the cable to provide a torque about the joint; and wherein the cable is configured to provide the torque by exerting a first force on the first crossbar supported between the first lateral strut and the first medial strut and a second force on the second crossbar supported between the second lateral strut and the second medial strut, and wherein the cable is further configured to provide the torque about the joint in a first direction.

2. The exoskeleton system of claim 1, wherein the exoskeleton device further comprises:

a third crossbar supported by a third lateral strut and a third medial strut each extending from the first portion of the frame on an opposite side to the first crossbar; and a fourth crossbar supported by a fourth lateral strut and a fourth medial strut each extending from the second portion of the frame on an opposite side to the second crossbar.

3. The exoskeleton system of claim 2, wherein the torque comprises a first torque, and wherein the third crossbar is coupled to the fourth crossbar by a device configured to provide a second torque about the joint in a second direction opposite to the first direction.

4. The exoskeleton system of claim 1, wherein the cable comprises a first cable, wherein the motor comprises a first motor, wherein the torque comprises a first torque, and wherein the exoskeleton system further comprises:

a second cable; and a second motor connected to the second cable and configured to cause the second cable to provide a second torque around the joint in a direction opposite to the first torque.

5. The exoskeleton system of claim 4, wherein the first motor and the second motor are each independently controlled by a controller.

6. The exoskeleton system of claim 1, wherein the first portion of the frame is attachable to an upper leg portion of a user and wherein the second portion of the frame is attachable to a lower leg portion of the user to cause the joint to be collocated with a knee of the user; and wherein the first direction corresponds to a direction of knee extension of the user, and wherein a second direction about the joint opposite the first direction corresponds to a direction of knee flexion of the user.

7. The exoskeleton system of claim 1, wherein the exoskeleton device further comprises a strain gauge affixed to the second crossbar, the strain gauge configured to measure a force of the cable on the second crossbar.

8. The exoskeleton system of claim 1, wherein the joint comprises an encoder configured to measure an amount of rotation of the joint.

9. The exoskeleton system of claim 1, wherein the joint comprises a triple pulley joint comprising:

a first pulley set coupled to the first portion of the frame by a first hinge;

a second pulley set coupled to the second portion of the frame by a second hinge; and a third pulley set coupled to the first pulley set and coupled to the second pulley set.

10. The exoskeleton system of claim 9, wherein the triple pulley joint is attached to the first portion of the frame by a first hinge enabling lateral translation of the first portion of the frame relative to the second portion of the frame, and wherein the triple pulley joint is attached to the second portion of the frame by a second hinge enabling varus or valgus rotation of the second portion of the frame with respect to the first portion of the frame, and wherein the triple pulley joint enables vertical translation, extension, and flexion movement of the second portion of the frame relative to the first portion of the frame.

11. The exoskeleton system of claim 9, wherein the triple pulley joint comprises a first cable configured to provide a first torque about the joint in the first direction, and a second cable configured to provide a second torque about the joint in a second direction opposite the first direction.

12. The exoskeleton system of claim 11, wherein the triple pulley joint comprises a third cable configured to prevent extension of the joint in the first direction past an extension threshold.

13. The exoskeleton system of claim 1, wherein the cable comprises a Bowden cable.

14. An exoskeleton device, comprising:

a frame comprising a first portion coupled to a second portion by a joint;

a first crossbar supported by a between a first lateral strut and a first medial strut each extending from the first portion of the frame;

a second crossbar supported between a second lateral strut and a second medial strut each extending from the second portion of the frame;

a third crossbar supported between a third lateral strut and a third medial strut each extending from the first portion of the frame on an opposite side to the first crossbar supported by the first lateral strut and the first medial strut;

a fourth crossbar supported between a fourth lateral strut and a fourth medial strut each extending from the second portion of the frame on an opposite side to the second crossbar supported by the second lateral strut the second medial strut;

wherein the first crossbar is configured to receive a first cable in a central portion of the first crossbar and to redirect the first cable toward the second crossbar, the first cable being spaced from the frame by the first lateral strut and the first medial strut and the second lateral strut and the second medial strut;

wherein the second crossbar is configured to anchor the first cable at a central portion of the second crossbar to enable the first cable to provide a first torque about the joint in a first direction for knee extension, the first cable being centered over the central portion of the first crossbar and the central portion of the second crossbar;

wherein the third crossbar is configured to receive a second cable and redirect the second cable toward the fourth crossbar, the second cable being spaced from the frame by the third lateral strut and the third medial strut and the fourth lateral strut and the fourth medial strut; and wherein the fourth crossbar is configured to anchor the second cable to enable the second cable to provide a second torque about the joint in a second direction, opposite the first direction, for knee flexion.

15. The exoskeleton device of claim 14, wherein the first portion of the frame is attachable to an upper leg portion of a user and wherein the second portion of the frame is attachable to a lower leg portion of a user to cause the joint to be collocated with a knee of the user.

16. The exoskeleton device of claim 14, further comprising:

a first sensor affixed to the second crossbar, the first sensor configured to measure a first force of the first cable on the second crossbar; and a second sensor affixed to the fourth crossbar, the second sensor configured to measure a second force of the second cable on the fourth crossbar.

17. The exoskeleton device of claim 14, wherein the first crossbar comprises a first pulley configured to redirect the first cable toward the second crossbar; and wherein the third crossbar comprises a mechanical device configured to redirect the second cable toward the fourth crossbar.

18. The exoskeleton device of claim 14, wherein the joint comprises an encoder configured to measure rotation of the joint.

19. The exoskeleton device of claim 14, wherein the joint comprises a triple pulley joint comprising:

a first pulley set coupled to the first portion of the frame by a first hinge;

a second pulley set coupled to the second portion of the frame by a second hinge; and a third pulley set coupled to the first pulley set and coupled to the second pulley set.

20. The exoskeleton device of claim 19, wherein the triple pulley joint is attached to the first portion of the frame by a first hinge enabling lateral translation of the first portion of the frame relative to the second portion of the frame, and wherein the triple pulley joint is attached to the second portion of the frame by a second hinge enabling varus or valgus rotation of the second portion of the frame with respect to the first portion of the frame, and wherein the triple pulley joint enables vertical translation, extension, and flexion movement of the second portion of the frame relative to the first portion of the frame.

21. The exoskeleton device of claim 19, wherein the triple pulley joint comprises a first inner joint cable configured to provide a torque about the joint in the first direction and a second inner joint cable configured to provide a torque about the joint in the second direction.

22. The exoskeleton device of claim 21, wherein the triple pulley joint comprises a third cable configured to prevent extension of the joint past an extension threshold.

23. The exoskeleton device of claim 14, wherein the first cable and second cable each comprises a Bowden cable.

* * * * *